US009437122B2

(12) United States Patent
Van Boom et al.

(10) Patent No.: US 9,437,122 B2
(45) Date of Patent: Sep. 6, 2016

(54) PAPER, LABELS MADE THEREFROM AND METHODS OF MAKING PAPER AND LABELS

(71) Applicant: Documotion Research, Inc., Santa Ana, CA (US)

(72) Inventors: Joel Van Boom, Santa Ana, CA (US); William R. Krahl, Baldwinsville, NY (US); Jeff Ehrmann, Santa Ana, CA (US)

(73) Assignee: Documotion Research, Inc., Santa Ana, CA (US)

( * ) Notice: Subject to any disclaimer, the term of this patent is extended or adjusted under 35 U.S.C. 154(b) by 0 days.

(21) Appl. No.: 14/578,261

(22) Filed: Dec. 19, 2014

(65) Prior Publication Data

US 2015/0339955 A1 Nov. 26, 2015

Related U.S. Application Data

(63) Continuation of application No. 13/794,641, filed on Mar. 11, 2013, now Pat. No. 9,058,753.

(60) Provisional application No. 61/614,771, filed on Mar. 23, 2012.

(51) Int. Cl.

| | |
|---|---|
| ***B41M 5/42*** | (2006.01) |
| ***G09F 3/00*** | (2006.01) |
| ***B08B 1/00*** | (2006.01) |
| ***B08B 7/00*** | (2006.01) |
| ***B41M 5/41*** | (2006.01) |
| ***B31D 1/02*** | (2006.01) |
| ***B41M 5/40*** | (2006.01) |
| *G09F 3/02* | (2006.01) |

(52) U.S. Cl.

CPC ..... *G09F 3/0286* (2013.01); *B08B 1/00* (2013.01); *B08B 7/0028* (2013.01); *B31D 1/02* (2013.01); *B41M 5/40* (2013.01); *B41M 5/41* (2013.01); *B41M 5/42* (2013.01); *G09F 3/02* (2013.01); *B41M 2205/04* (2013.01); *B41M 2205/36* (2013.01); *G09F 2003/0201* (2013.01); *G09F 2003/0211* (2013.01); *G09F 2003/0245* (2013.01); *G09F 2003/0248* (2013.01); *Y10T 428/24331* (2015.01); *Y10T 428/24893* (2015.01); *Y10T 428/24934* (2015.01)

(58) Field of Classification Search

CPC ..... B41M 5/42; B41M 2205/36; G09F 2003/0245; G09F 2003/02148; G09F 2003/0248; B08B 1/00; B08B 7/0028; Y10T 428/24934; Y10T 428/24992; Y10T 428/24802; Y10T 428/24942

USPC ..... 503/200, 206; 428/211.1, 219

See application file for complete search history.

(56) References Cited

U.S. PATENT DOCUMENTS

| | | | |
|---|---|---|---|
| 2,170,147 | A | 8/1939 | Lane |
| 2,510,120 | A | 6/1950 | Leander |
| 4,139,613 | A | 2/1979 | Hefele |
| 4,214,024 | A | 7/1980 | Jacobson |
| 4,388,362 | A | 6/1983 | Iwata |
| 4,460,634 | A | 7/1984 | Hasegawa |
| 4,768,810 | A | 9/1988 | Mertens |
| 4,771,891 | A | 9/1988 | Sorensen |
| 4,851,383 | A | 7/1989 | Fickenscher et al. |
| 4,884,826 | A | 12/1989 | Slagsvol |
| 4,889,234 | A | 12/1989 | Sorensen et al. |
| 5,194,299 | A | 3/1993 | Fry |
| 5,284,689 | A | 2/1994 | Laurash et al. |
| 5,292,713 | A | 3/1994 | Stenzel et al. |
| 5,336,541 | A | 8/1994 | Kobayashi |
| 5,351,426 | A | 10/1994 | Voy et al. |
| 5,383,686 | A | 1/1995 | Laurash |
| 5,506,016 | A | 4/1996 | Onodera |
| 5,578,352 | A | 11/1996 | Smith |
| 5,591,290 | A | 1/1997 | Walter et al. |
| 5,661,099 | A | 8/1997 | Mitchell |
| 5,686,169 | A | 11/1997 | Hassall |
| 5,738,383 | A | 4/1998 | Main et al. |
| 5,750,192 | A | 5/1998 | Smith |
| 5,782,496 | A | 7/1998 | Casper et al. |
| 5,827,609 | A | 10/1998 | Ercillo et al. |
| 5,840,657 | A | 11/1998 | Mehta et al. |
| 5,942,062 | A | 8/1999 | Hassall |
| 6,060,428 | A | 5/2000 | Chang |

(Continued)

FOREIGN PATENT DOCUMENTS

| | | | |
|---|---|---|---|
| CN | 101429413 | A | 5/2009 |
| DE | 3230579 | C2 | 2/1984 |

(Continued)

OTHER PUBLICATIONS

Semi-Automatic Skip Glue Labeling Machine, Accutek packaging Equipment Company, Inc. (the publication date unidentifiable from the copy submitted herewith).

"Label Construction" IP.com, An IP.com Prior Art Database Technical Disclosure, IP.com No. IPCOM000035547D, dated Jan. 24, 2005.

Tomkins, D.W., "Security applications of embossed holograms" , Joint Divisional Manager, Advanced Holographic Laboratories Loughborough University, Loughborough, Leicestershire, UK (1990).

Bean, Harry, "Printed Self-Adhesive Label for Installation on a Round Electrical Cord," IP.com, an IP.com Prior Art Database Technical Disclosure, IP.com No. IPCOM000006251D, Dec. 1, 1991.

(Continued)

*Primary Examiner* — Bruce H Hess

(74) *Attorney, Agent, or Firm* — Knobbe, Martens, Olson & Bear LLP

(57) ABSTRACT

Paper is disclosed for use in making repositionable or removable adhesive labels. The adhesive can be applied in patches or discrete areas to the paper or to a layer of material that cleans rollers in the manufacturing line and/or in printers. The adhesive can be applied in single or multiple layers. The paper is light weight paper and preferably thermal paper for use in POS printers.

22 Claims, 14 Drawing Sheets

(56) References Cited

U.S. PATENT DOCUMENTS

| | | | |
|---|---|---|---|
| 6,268,032 | B1 | 7/2001 | Mertens et al. |
| 6,309,745 | B1 | 10/2001 | Willms et al. |
| 6,383,631 | B1 | 5/2002 | Mehta |
| 6,408,553 | B1 | 6/2002 | Brown et al. |
| 6,423,392 | B1 | 7/2002 | Koch et al. |
| 6,511,725 | B1 | 1/2003 | Rawlings |
| 6,585,437 | B1 | 7/2003 | Wiklof et al. |
| 6,596,359 | B2 | 7/2003 | Roth et al. |
| 6,686,014 | B1 | 2/2004 | Washburn et al. |
| 6,777,065 | B2 | 8/2004 | Grynaeus et al. |
| 6,830,795 | B1 | 12/2004 | Downs |
| 6,833,172 | B1 | 12/2004 | Schwartz |
| 6,890,112 | B2 | 5/2005 | Kline |
| D513,768 | S | 1/2006 | Anduss |
| 6,986,935 | B2 | 1/2006 | Kalbe et al. |
| 7,094,453 | B2 | 8/2006 | Bourdelais |
| 7,122,235 | B2 | 10/2006 | Bourdelais et al. |
| 7,329,449 | B2 | 2/2008 | Wiklof et al. |
| 7,588,811 | B2 | 9/2009 | Blank et al. |
| 7,742,366 | B2 | 6/2010 | Haas |
| 7,820,264 | B2 | 10/2010 | Blank et al. |
| 7,947,366 | B2 | 5/2011 | Ishiwatari et al. |
| 8,163,365 | B2 | 4/2012 | Weiner et al. |
| 8,309,207 | B2 | 11/2012 | Kuiper |
| 8,445,104 | B2 | 5/2013 | Vigunas et al. |
| 8,537,184 | B2 | 9/2013 | Roth et al. |
| 9,058,753 | B2 | 6/2015 | Van Boom et al. |
| 2002/0142156 | A1 | 10/2002 | Maloney |
| 2003/0113500 | A1 | 6/2003 | Ingerslew et al. |
| 2003/0116453 | A1 | 6/2003 | Russo et al. |
| 2003/0223800 | A1 | 12/2003 | Wiklof et al. |
| 2004/0001930 | A1 | 1/2004 | Roth et al. |
| 2004/0053045 | A1 | 3/2004 | Glenna et al. |
| 2004/0067088 | A1 | 4/2004 | Kline |
| 2004/0192146 | A1 | 9/2004 | Sturgill |
| 2004/0221944 | A1 | 11/2004 | Havard et al. |
| 2004/0252321 | A1 | 12/2004 | Buck et al. |
| 2005/0136370 | A1 | 6/2005 | Brennan et al. |
| 2005/0208250 | A1 | 9/2005 | Blank et al. |
| 2005/0255298 | A1 | 11/2005 | Crum |
| 2006/0130975 | A1 | 6/2006 | Takahashi et al. |
| 2006/0134365 | A1 | 6/2006 | Blank et al. |
| 2006/0263594 | A1 | 11/2006 | Kraft et al. |
| 2007/0267146 | A1 | 11/2007 | Vigunas et al. |
| 2008/0223512 | A1 | 9/2008 | Sievel |
| 2008/0307686 | A1 | 12/2008 | Wade et al. |
| 2009/0061222 | A1 | 3/2009 | Grobe |
| 2009/0169282 | A1 | 7/2009 | Keeton |
| 2009/0258116 | A1 | 10/2009 | Peyton et al. |
| 2010/0015374 | A1 | 1/2010 | Fulwiler |
| 2010/0086778 | A1 | 4/2010 | Fidan et al. |
| 2010/0298747 | A1 | 11/2010 | Quinn |
| 2011/0091811 | A1 | 4/2011 | Song et al. |
| 2011/0100557 | A1 | 5/2011 | Cooper |
| 2011/0159241 | A1 | 6/2011 | Xia et al. |
| 2011/0205326 | A1 | 8/2011 | Roth et al. |
| 2011/0244201 | A1 * | 10/2011 | Sato ..... B42D 5/003 428/211.1 |

FOREIGN PATENT DOCUMENTS

| | | | |
|---|---|---|---|
| DE | 4101214 | A1 | 7/1992 |
| DE | 19724647 | C1 | 4/1999 |
| DE | 102004048582 | A1 | 4/2006 |
| EP | 0 042 073 | B1 | 2/1984 |
| EP | 0 295 483 | A | 12/1988 |
| EP | 3 429 82 | A2 | 11/1989 |
| EP | 0 326 139 | A3 | 12/1990 |
| EP | 0 422 823 | A | 8/1991 |
| EP | 0 600 622 | A | 6/1994 |
| EP | 1 053 289 | B1 | 8/2002 |
| EP | 1 302 333 | A3 | 11/2003 |
| EP | 1 431 948 | | 6/2004 |
| EP | 1 577 860 | B1 | 9/2010 |
| GB | 2259888 | A | 3/1993 |
| JP | 2000003134 | A | 1/2000 |
| JP | 2002333837 | A | 11/2002 |
| JP | 2003/330370 | A | 11/2003 |
| WO | 93/09925 | A2 | 5/1993 |
| WO | 97/07985 | | 3/1997 |
| WO | 00/12224 | A1 | 3/2000 |
| WO | 2009126328 | A3 | 10/2009 |
| WO | 2010008629 | A1 | 1/2010 |
| WO | 2011/036349 | A1 | 3/2011 |

OTHER PUBLICATIONS

Pollard, R, "Label Adhesive Back Release Tool," IP.com, an IP.com Prior Art Database Technical Disclosure, IP.com No. IPCOM000045786D, Apr. 1983.

Holovka, C., "Label Applicator", IP.com, an IP.com Prior Art Database Technical Disclosure, IP.com No. IPCOM000080490D, Dec. 1, 1973.

"Technique for Applying Labels," IP.com, an IP.com Prior Art Database Technical Disclosure, IP.com No. IPCOM000024729D, Dec. 31, 1981.

Drennan, et al., "Pressure Sensitive Adhesive Label Placement Apparatus," IP.com, an IP.com Prior Art Database Technical Disclosure, IP.com No. IPCOM0000116426D, Sep. 1, 1995.

Czander, W.E. et al., "Pharmaceutical Packaging Operations," Chapman & Hall 1997.

"Electrostatic Dissipating Label Stock," IP.com, an IP.com Prior Art Database Technical Disclosure, IP.Com No. IPCOM000143854D, dated Dec. 11, 2006.

Amended Complaint, *NCR Corporation* v. *Documotion Research, Inc.*, C.A. No. 14-395-GMS, May 13, 2014.

Shanghai Liu Xiang General Equipment Co., Ltd., retrieved from http://shcharms.en.alibaba.com/productshowing/252905178-211966559/Double_Layer_Gluing_Machine.html printed Feb. 14, 2012 in 2 pages.

SenSura Adhesives, "SenSura Double-Layer Adhesive, SenSura Adhesive, SenSura Convex Light, SenSura Xpro", retrieved from http://www.us.coloplast.com/products/ostomy/sensura_adhesives?commcategory=SenSura_Flex(Coloplast)&propertyname=SenSura_adhesives, 2 pages.

V.A. Clasessens, "Artists' Canvas," retrieved from http://www.claessens-va.be, 2 pages.

International Search Report and Written Opinion issued on Oct. 4, 2013 for International Application No. PCT/US2013/033590.

MAXStick—The world's first liner-free, repositionable thermal label. Product Options. Jun. 3, 2011. Internet Archive Wayback Machine. http://web.archive.org/web/20110603062534/http://www.maxstick.com/options_10.aspx. 1p.

MaxStick—The world's first liner-free, repositionable thermal label. How MAXSTICK works. Feb. 2, 2011. . Internet Archive Wayback Machine, http://web.archive.org/web/20110202111229/http://www.maxstick.com/. 2pp.

MaxStick—Innovation that sticks Jul. 5, 2009, Intern Archive Wayback Machine, http://web.archive.org/web/20090705112517/http://www.maxstick.com/; Max Inspiration Aug. 5, 2009, Intern Archive Wayback Machine, http://web.archive.org/web/20090805061543/http://www.maxintl.com 2pp.

* cited by examiner

PAPER, LABELS MADE THEREFROM AND METHODS OF MAKING PAPER AND LABELS

INCORPORATION BY REFERENCE TO ANY PRIORITY APPLICATIONS

Any and all applications for which a foreign or domestic priority claim is identified in the Application Data Sheet as filed with the present application, are hereby incorporated by reference under 37 CFR 1.57.

FIELD

This disclosure is concerned with paper, labels produced from such paper and the manufacture of such paper and labels and their use. More particularly, this disclosure is concerned with lightweight, preferably thermal, paper having certain coatings and removable/repositionable adhesive labels that can be produced from such paper.

BACKGROUND

Labels, such as those described herein, are useful articles in a variety of industries and facilitate the conveyance of information. They may, for example, convey information on the articles they are attached to, such as pricing, special features of an order, the identity of the intended customer and the like. They may also need to be removed without damaging the surface or leaving a residue on the surface to which they have been applied.

However, the production of self-wound labels having optimum performance characteristics often presents many challenges. For example, in the field of point-of-sale (POS) printers that produce adhesive labels, it is difficult to avoid adhesive fouling moving parts of the printer, such as rollers and cutting blades, and to avoid jamming of the printer.

The requirement that such labels have enough adhesive to stick reliably to substrates is inconsistent with smooth running of the printer, because more adhesive on the paper increases the likelihood of buildup of adhesive in the printer and jamming of the paper.

DESCRIPTION OF THE RELATED ART

These problems have been addressed by using relatively heavy weight paper to carry sufficient adhesive and using permanent adhesive to provide sufficient adhesion. In practice, some compromise is usually made and it is relatively common to experience jamming and/or fouling of the printers as a result. Moreover, many of the adhesives used comprise components that cause printer wear and/or are not environmentally sound. For example, most labels that use a permanent adhesive to ensure sufficient tack utilize a silicone based release. Silicone based release products are not environmentally friendly and can cause excessive wear on and shorten the useful life of a printer.

In these and many prior art systems, the adhesive must be kept to a minimum to keep from fouling the printer and the cutting blade. Another approach to that goal has been to use timing marks and adhesive spaced apart on the paper to register the paper in the printer so that the cutting blade never cuts through the glue, which likely would be a substantial problem when using permanent adhesive. Permanent adhesive must be used in this format that requires a minimal amount of glue so that the label has sufficient tack. The permanent adhesive is problematic in the printer, even in these small quantities, as it tends to cause jamming and the glue can foul the print head and thereby reduce the print quality and the useful life of the printer.

In the case of removable/repositionable adhesive labels, it has proven particularly difficult to make labels on the more inexpensive lightweight paper with sufficient tack and that minimize paper jamming and adhesive build up in the printer.

SUMMARY

This disclosure provides paper and repositionable paper labels made of lightweight paper stock. They are typically made from thermal paper. The paper is particularly suited for use in POS printers and is typically provided in the form of rolls sized to fit particular commercial printers, for example 40 mm or 80 mm wide. By cutting, tearing or other means of separation, repositionable paper labels can be produced from such printers. The labels find use in a variety of industries, particularly the food service and packaging industries, for example in restaurants and fast food facilities or hospitals. The labels can serve as a receipt or indicator of content or an order. For example, the labels can indicate who ordered food, what the food is, how much it costs and the like. The labels can be temporarily attached to food containers, such as boxes, bags, food trays and the like, as a means of ensuring that the food reaches the intended consumer. The labels can be removed without damaging or leaving a significant residue on the surface to which they have been applied. This is an important feature for users, such as in hospitals where these labels can be used to label meal trays for patients. Any glue left on the meal tray after removal of the label would be a potential health risk as such residual glue would attract bacteria. Thus, these removable labels eliminate the need for extra cleaning and scrubbing of the hospital meal trays and are desirable.

The paper is printable and the labels made from the paper are removable/repositionable. They can have a promising combination of features hitherto not attainable, such as lightweight and therefore inexpensive paper, relatively high amounts of adhesive, so that the removable/repositionable paper reliably remains stuck to smooth and uneven surfaces, such as those of containers. In view of their construction, paper disclosed herein provides for the cleaning of the printer components during use, which creates substantially less adhesive build up on the rollers and cutting blades of printers and can avoid jamming the printers and fouling of the print head.

This disclosure provides paper that is self-cleaning of the components of a printer through which the paper passes, notably cutting mechanisms and rollers. While prior approaches to addressing printer fouling by adhesive on the paper and paper jams has been to avoid or minimize contact between the adhesive and components, the principal focus here is to provide paper carrying material or materials having cleaning properties, so that such material attracts and/or picks up adhesive residue. Moreover, and as described more fully herein, the adhesives and the materials having cleaning properties are applied in sizes, shapes, layers, positions, proportions, and/or patterns or stripes that allow for the customization of the finished product so that it will perform reliably while running through a particular printer and also allow for the desired label adhesion and positioning of the adhesive to suit the end user.

This disclosure provides at least three paper roll constructs to allow for cleaning of the printer components during use and thereby address the risk of adhesive build up on printer components, such as rollers and cutting mechanisms.

1. One in which adhesive is applied in discrete areas, typically in a pattern, such as patches, islands or spots, repeated along the roll, in one or more layers, but typically two, on top of one or more layers, but typically one, of material having an affinity for the adhesive, so that material acts as a cleaning agent or cleaning layer(s) for the adhesive;
2. another in which adhesive is applied in a relatively light (such as 2 or less gsm dry, for example 1-1.5 gsm), base comprising one or more layers, but typically one, on one or more layers of such material having an affinity for the adhesive, but typically one, with one or more additional layers of adhesive over the adhesive base layer(s) in the form of such discrete areas of adhesive (in one or more layers, but typically one or two) (the base layer forming or the base layers together forming one or more continuous or substantially continuous columns, so that the base layer(s) adhesive extends across the width of the roll or leaves adhesive free zones running along the edges of the roll or is in a column or columns on each side of the longitudinal axis of the roll); and
3. another in which adhesive is applied in a relatively heavy (such as 4 or more gsm dry, for example 6-10 gsm) base, comprising one or more layers, but typically one or two) on one or more layers of such material having an affinity for the adhesive, but typically one, with one or more additional layers, but typically one, of such material having an affinity for the adhesive over the adhesive and windows or holes through such additional layers, so that a pattern of adhesive is exposed through the windows or holes, such as said discrete areas (the base layer forming or the base layers together forming one or more continuous or substantially continuous columns, so that adhesive extends across the width of the roll or leaves adhesive free zones running along the edges of the roll or is in a column or columns on each side of the longitudinal axis of the roll.

These constructs may have the features and characteristics described in this disclosure.

This disclosure provides paper, suitable for use as removable or repositionable labels, comprising: a paper substrate, having a weight of less than about 70 gsm, a width extending between lateral edges, a longitudinal axis extending along the center of the width, a first side and a second side, the first side supporting at least one release layer; the second side supporting at least one layer of adhesive; at least one layer of material between the adhesive and the paper, which material aids in cleaning printer components when the labels are being printed; the adhesive being in the form of a plurality of substantially discrete adhesive areas having a dry weight per unit area of the paper, the adhesive areas being separated by adhesive having a lower dry weight per unit area of the paper and/or by exposed cleaning material.

This disclosure provides paper, suitable for use as removable or repositionable labels, comprising a paper substrate, having a weight of less than about 70 gsm, a width extending between lateral edges, a longitudinal axis extending along the center of the width, a first side and a second side; the first side supporting a release layer; the second side supporting: at least one layer of adhesive located on both sides of said longitudinal axis; at least one layer of material having an affinity for said adhesive and located between and in contact with the paper and said at least one adhesive layer; a pattern of adhesive formed by either at least one additional layer of adhesive on said at least one layer of adhesive or at least one additional layer of material having an affinity for said adhesive on said at least one layer of adhesive and having holes there through to expose adhesive of said at least one layer of adhesive and thereby form said pattern.

This disclosure provides paper, suitable for use as removable or repositionable labels, comprising: a paper substrate, having a weight of less than about 70 gsm, a width extending between lateral edges, a longitudinal axis extending along the center of the width, a first side and a second side, the first side supporting a release layer; the second side supporting at least one layer of an adhesive cleaning material; a pattern of adhesive on the adhesive cleaning material; the pattern of adhesive being disposed on both sides of the longitudinal axis in the form of a plurality of substantially discrete adhesive areas, so that the adhesive along the paper in the direction of the longitudinal axis is not continuous; at least some of the adhesive areas being applied in multiple layers.

This disclosure also provides rolls of thermal paper, the paper having a weight of less than about 70 gsm; the roll comprising a first side treated with thermally reactive material, a top coat over the thermally reactive material and a release layer on the topcoat; an adhesive cleaning layer on the other side of the paper and adhesive on the cleaning layer; the adhesive being such that labels produced from the roll are removable or repositionable; the adhesive being in discrete areas surrounded by exposed cleaning layer.

This disclosure provides rolls of paper, for producing removable or repositionable adhesive labels on a POS printer, the paper having a weight of less than about 70 gsm, the roll comprising on one side of the paper adhesive in the form of substantially discrete patches applied to one or more intervening layers between the paper and the adhesive; the amount of adhesive on the paper being from about 6 to about 18 gsm, preferably from about 8 to about 10 gsm, of dry adhesive.

This disclosure provides rolls of paper, having a weight of less than about 70 gsm, and having adhesive patches along the length of the roll to produce at least one repeat pattern in that direction; each repeat pattern having a repeat length; the patches being separated by areas of non-adhesive material that has an affinity for the adhesive; the spacing of the adhesive and non-adhesive being configured to interact with a printer having a platen roller to facilitate the passage of the paper through the printer, the platen roller having a circumference; the ratio of each repeat length to the circumference being not a whole number. Such rolls can have one or two repeat lengths. Each repeat length is preferably less than the circumference. The circumference can be one to two inches or more.

The paper is less than about 70 gsm. It can be 40 to 65 gsm, preferably 55 gsm.

The paper is cut into rolls that are typically 40, 58, 80 or 102 mm wide, and can be made into any width to fit a particular printer.

The construction of the paper for the labels is preferably as follows. The paper is preferably thermal paper, thereby having on one side a surface treatment that is sensitive to heat and chemicals so as to induce printed indicia. On the thermal side of the paper a top coat can be provided which may be applied in one or more layers, for example, by flood coating. For example, thermal paper can be purchased that already includes a suitable top coating or the top coating can be applied as part of the manufacturing process. Significant savings are achieved by applying the top coat in line with the coating process described herein as the top coated lightweight paper can cost 40% to 90% more than the non-top coated lightweight paper. On top of the top coat, or the paper if no top coat is used, a release layer is provided. The release layer is preferably not silicone based. On the other side of the paper a cleaning layer or layers is applied to the paper directly or to a primer or base coat layer, preferably again by flood coating. It is understood that the release layer and the cleaning layer could be applied in continuous bands so that it is continuously in line and fully spans the width of any adhesive that has been applied. Adhesive is applied to the cleaning layer(s) on the opposite side from the thermal side of the paper. Accordingly, when the paper is formed into a roll the release layer will contact the adhesive and allow the paper to be unwound without sticking. The adhesive can be in one or more layers and in the patterns described herein. One or more cleaning layers can be provided over the adhesive with "windows" openings or holes through the cleaner to create a pattern of adhesive operative through the "windows" openings or holes. This is particularly useful when the adhesive is along the paper in a continuous or substantially continuous column or columns in the form of plain stripes or bands with no other patterns.

The adhesive is a temporary, non-permanent or pressure sensitive adhesive that permits the paper when cut into labels to form removable/repositionable labels that may be temporarily stuck to articles to convey the requisite information.

Preferably, the adhesive is a water based adhesive and therefore is an aqueous formulation. Preferred adhesives are environmentally sound and avoid use of solvents. Preferred adhesives are microsphere adhesives, although a repositionable, removable, or low-tack permanent adhesive can be used. UV curable adhesives can also be used.

The adhesive can be applied in various patterns. The adhesive can be non-continuous along the longitudinal length of the paper. Some preferred patterns include discrete shapes surrounded by areas of non-adhesive, such as the cleaning material. Suitable shapes include squares, rectangles, circles, ovals, polygons, diamonds and parallelograms. Included in preferred shapes are parallelograms having two internal angles greater than 90°. Further, such parallelograms may have rounded external corners. Some preferred designs include areas provided at an angle to the longitudinal axis of the paper and on each side of that axis. Such patterns can include those that are applied at any angle to the longitudinal axis from zero to ninety degrees, but the angle is preferably between 20 and 70 degrees, such as about 45°. Preferably, the angle points in the direction of the web, that is in the direction of printing This array of angled shapes of separate and distinct adhesive areas or spots create a pattern where at any point of the roll there is adhesive and cleaning agent in contact with any part of the printer that runs laterally across the paper web, but particularly with the rollers, such as the platen roller in a printer. This allows for a smooth unwinding of the roll and is preferred. This pattern may also have a break in the middle or in multiple points across the web that produces a substantially adhesive free line or zone along the paper, for example along the longitudinal center line in a roll of the paper. Such adhesive free zones running longitudinally along the paper can be positioned in one or more locations so that they provide for an adhesive free zone for a paper guide to make contact with the adhesive side of the paper during processing to help guide the paper through the printer without touching any adhesive. The same patterns, shapes and zones can be created using the window approach described above.

The adhesive can be applied in a continuous manner along the longitudinal length of the paper. Continuous adhesive can be one or more bands along the roll, preferably with at least one band on each side of the longitudinal axis of the paper roll, The amount of adhesive that can be applied in a continuous band is directly related to the method of construction chosen. If method 2 (light continuous band with heavier spots on top) is chosen, then the glue in the continuous band must be less than or equal to about 2 gsm dry. This is because such a light coating of glue, when placed on top of the cleaning material, forms a cleaning layer. If method 2 (windows through cleaning agent) is chosen, then the glue should be at least 6 gsm dry. It is understood that the cleaning agent, as applied in method 3, shall reduce, but not necessarily eliminate, the tack of the underlying adhesive. This reduction in tack can reduce the tack in the area coated with the cleaning agent to from 0% to 60% of the tack in the non-covered area, but preferably reduces the tack in the covered area to between 15% and 30% of the tack in the non-covered area.

The amount of adhesive applied to the paper can determine the tackiness of the label for a given adhesive. It is particularly difficult to apply adhesive to lightweight paper and achieve sufficient tack. Lightweight paper is relatively flimsy. Aqueous adhesive can saturate the paper with water, making the paper difficult to dry and can deform the paper. Additionally, heat is generally used to dry the adhesive and the more adhesive that is applied the greater the requirement for heat, and care must be taken not to heat the paper to the point the thermal coatings activate and the paper discolors or turns black.

The adhesive can be applied to cover a surface area of the paper with a high percentage of adhesive. The percentage coverage can be more than 60% of the width of the paper, preferably from 25% to 90%, more preferably from 75% to 80%, calculated as the percent ratio of the width of adhesive to the width of the paper. When using method 1 (discrete spots of adhesive with dry areas in between), the adhesive preferably covers at least 25% of the total surface area of the paper, more preferably, from 35 to 65%, for example, 40% to 50%. When using methods 2 and 3 (using continuous bands of adhesive), the adhesive preferably covers 25% to 90% of the total surface area of the paper, more preferably 50%-80%.

Thus, a first application of adhesive can form a pattern of discrete adhesive areas, or one or more continuous or substantially continuous strips or bands. The first application can apply areas of a certain size and each subsequent, for example in the case of two applications or layers, the second application or layer can be in larger adhesive areas than the previous, or first, application. For some usages, each subsequent layer of adhesive is not applied outside of the adhesive areas of the previous layer or layers. Each subsequent layer is preferably substantially the same and/or less size than each of the previous layer or layers. When the first layer is one or more continuous or substantially continuous strips or bands it is preferred that adhesive either cover the width or the majority of the width of the roll, for example leaving adhesive free zones along each edge of the paper, as described herein, or be two or more columns with at least one column on each side of the longitudinal axis of the roll, the columns preferably extending the length of the roll. The columns may have the same or different widths. The adhesive applied in the multiple applications can be the same each time or can be different. The amount of adhesive applied in each application can also be the same or different. Preferably there are two or three applications of adhesive and the first application deposits less adhesive than each of the subsequent application or applications.

Preferably, the adhesive is applied to the paper in more than one layer. Preferably a plurality of layers of adhesive are used for example, two or three. The adhesive can be applied in a plurality of passes or "shots" in the manufacturing process. Preferably, the number of applications are two or three or more. Multiple applications can be in register such that the overall shape of the adhesive applied is the same or may be somewhat superimposed or lie partially upon, or within the previous application. Superimposed or within is preferred.

It is preferred that the amount of adhesive in the first layer be less than that in the subsequent layer or collective layers. In particular, a relatively light first layer, preferably as a column that is continuous or substantially continuous, especially one that spans the longitudinal axis, can be used with one or more layers on top in a pattern (such as those disclosed herein) that collectively provide a relatively heavy layer or layers. With these approaches, the first layer can provide a certain amount of tack and the subsequent layer or layers collectively can provide more tack than the first layer. Then the first and subsequent layer(s) can cooperate together to enhance performance of the printer and/or provide labels with enhanced tack. Indeed, the use of a light first layer with a heavier subsequent layer or layers can increase the tack of the adhesive used to stick the labels to articles. The first layer can be about 20-95% by weight of the subsequent layer(s), preferably 20-50%. For many applications, a two layer system is useful. In such systems, the first layer can be about 50% by weight of the second layer. With the light, base coat of adhesive approach, the amount of adhesive is preferably about 2 gsm dry weight, or less, such as 1-1.5 gsm.

In order to facilitate drying of the adhesive at the manufacturing process, the adhesive may have preferable solids content, such as from 25% to 75%, more preferably from 40% to 55%, most preferably about 47% solids by weight.

In POS printers, a persistent problem is the deposition of adhesive, adhesive residue or other adhesive components on the rubber roller over which the paper passes on its way out of the printer. After adhesive residue or other adhesive component off the paper builds up on this roller, the paper will tend to stick to the roller and rotate with it. When using lightweight paper as described herein, as it is more flimsy than heavier weight papers that have been commonly used, this sticking can cause the paper to wrap around the roller causing the paper to jam the printer.

This disclosure provides an adhesive pattern on the paper comprising a repeating pattern of adhesive along the web in which adhesive portions or areas of the pattern are separated by adhesive free cleaning portions or areas.

Preferably these adhesive free bands or zones expose the cleaning agent layer in a pattern that is out of sync with the circumference of the roller that pulls the paper through the printer. When the first layer of adhesive is in one or more columns, the pattern can be provided by the subsequent layer(s) or by the "windows" in the outer cleaning layer, described above.

The length of the repeat in the adhesive pattern is selected to be different from the circumference of the roller so that the pattern when traveling through the printer is out of synchronization with the roller, so that each time the roller turns one revolution, the cleaning agents and adhesive, or the pattern of adhesive itself, will touch the roller in slightly or completely different areas than the previous revolution of the roller. By rotating the cleaning agents around the roller in this way allows the cleaning portions keep the roller substantially free of adhesive as the paper passes by it. Because the adhesive pattern is designed so that adhesive does not repeatedly contact the roller in the same place or places, there is less opportunity for adhesive build up on the roller. In addition, the cleaning portions or areas continuously sweep the roller to substantially eliminate build-up of adhesive on the roller. Preferably, if R is the length of the repeat pattern in the adhesive on the paper (measured from the leading edge of an area, portion or patch of adhesive plus the gap of non-adhesive area behind it to the next, following area, portion or patch of adhesive). Then the ratio of R to C, the circumference of the roller is not a whole number. Preferably, R should be less than the circumference of the relevant roller. This allows for at least some of the cleaning agent to come in contact with the rubber roller on every revolution of the rubber roller and is preferred. It is appreciated that R can exceed C, but the greater the excess the less regularly the cleaning agent will be applied to the rubber roller and thereby will reduce the benefits of the cleaning pattern. In no case should R exceed 4 C. For example, if the circumference of the roller is 2", then the adhesive and cleaning agent pattern could be in a repeat that is, for example, at 1.5".

The pattern of adhesive is preferably on both sides of the center line of the roll of commercial printer paper. The adhesive may be in areas along the roll such that the adhesive is not continuous on the paper. The adhesive is typically in one or more columns along the length of the paper. The columns can be continuous or substantially continuous or can be formed by discrete shapes. Preferably, the discrete shapes repeat along the column(s). The adhesive can be in a single column on the center line, or, for example, in one column on both sides of the center line. Of course, the paper from the coating line or press can have multiple "rolls" of paper alongside each other that are subsequently to be slit into the individual rolls. However, the arrangement can be asymmetrical—either in that these adhesive areas are a different area or shape or spaced differently, typically on each side of the roll's center line. In the latter case, there may be more than one repeat, eg of lengths R1 and R2. Then, also, each repeat ratio is not a whole number.

Because there are a limited, relatively small number of POS printers on the market designed to process self-wound sticky rolls of paper, these ratios can easily be determined for a particular model of printer.

For example, commercial POS printers typically have a roll with a circumference of about 1.42 or 2 inches. Practical rollers could be as large as about 3.5 inches in circumference. So, preferably, the repeat length in this disclosure is less than 3.5 inches; more preferably less than 2 inches; most preferably between 0.5" and 1.85".

Coating or printing adhesive on a surface has always been tricky. This is because the web of paper normally has to travel over, under and around rollers to move through the coating process. When the adhesive side of the paper hits a roller, care has to be taken to ensure that the adhesive does not build up on the roller. The danger is that it can either "track" or leave traces of adhesive outside the intended pattern. Even worse, an adhesive build up can deposit "glue globs" on the web where substantial chunks of adhesive build up on the roller and then get taken away by the web. This is normally avoided by use of a coating on the roller that includes silicone, Teflon or other components that repel adhesive.

When using microspheric adhesive, there is still a tendency for adhesive residue to build up on the rollers—even when they have been coated with silicone. This is also seen on the thermal printers designed to use sticky rolls where the rubber rollers are coated/impregnated with silicone or the like. Even on the printers with these coated rollers, a continuous application of the microspheric adhesive can cause a build-up. The printers only run at 60 feet per minute. The coating lines can run over 500 feet per minute and any buildup will be magnified.

Moreover, in a coating line is it sometimes not possible to coat all the rollers that touch the adhesive because some are in the coating/print area and cannot be modified. Therefore, this disclosure can also provide for the cleaning agent to be applied in a pattern that is also out of sync with the diameter of the rollers in the coating line/press. By doing so, we ensure that it is ensured that there will not be buildup during the coating process that will cause "glue globs" to be deposited on the paper. Any glue globs that get onto the roll will create a very high likelihood of jamming in the printer.

Accordingly, this disclosure also provides a method of making paper where the principles discovered regarding the relationship between the repeat pattern of the adhesive and the circumference of the printer roller is also applied to the paper manufacturing process. So, preferably, the coating line idler roller in that process that have contact with the adhesive have a circumference of about C' and the ratio of the repeat pattern and C' is also not a whole number.

For example, typical line rollers may have a circumference of between 6 and 13 inches.

This disclosure can select parameters that satisfy both the potential adhesive build up characteristics of both the coating process and the printer process by using a repeat pattern where R/C and R/C' is not a whole number. More preferably R<C or 0.33C'.

The amount of adhesive applied in a longitudinal line compared to the amount of cleaning agent will be an important factor in determining how tacky the glue will be and will also determine how much cleaning agent is thereby put in contact with the various printer components during processing. The greater the percentage of adhesive, the greater the tack, but the less the roll will clean the printer components. A balance can be made for each application. The pattern can be selected to provide a sufficient amount of tack to the individual label for the given application requirement and still leave enough cleaning agent between the adhesive spots to keep the printer, and most particularly the platen roller, clean and minimize paper jams.

Depending on the method chosen, the percentages of adhesive applied can range from 10% to 100% of the linear length of the paper. When approach 1 in paragraph [00012] is chosen, the preferred range is 55% to 80%. Conversely, with approach 1 the percentages of cleaning agent applied in a longitudinal line can range from 10% to 90%, with a preferred range of 20% to 50%. The most preferred arrangement using approach 1 (discrete spots of adhesive surrounded by cleaning agent) would be 65% to 80% adhesive and 20% to 35% cleaning agent. The larger the individual patches of adhesive the better the label will stick to relatively uneven surfaces. For example, a pattern that has an adhesive patch with a height of 0.625" and a cleaning pattern of 0.25" disposed in between would have a glue percentage of 71.4% and a cleaning percentage of 29.6%. Conversely, an adhesive pattern of 0.375" and a cleaning pattern of 0.125" would have the same percentage for each component, but the larger patches would be tackier on uneven surfaces as the larger patches of adhesive will bond better to such surfaces. When using approaches 2 or 3 in paragraph [0012] (continuous bands of adhesive), the percentage of adhesive on the linear length is 100%, The light coating of adhesive described in approach 2, when placed on top of the cleaning agent, acts as a cleaning layer. This is because the adhesive, when applied in such a light coat weight and anchored to the construction by the underlying cleaning agent, has an affinity to pick up adhesive or adhesive residue it comes in contact with and thereby performs similarly to exposed cleaning agent. In approach 3 (windows of cleaning agent), the cleaning agent on top of the adhesive can create the same patterns and proportions described above for approach 1 and, because it comes in direct contact with the rubber roller and printer components, also performs similarly to the exposed cleaning agent in approach 1.

Accordingly, this disclosure also provides the combination of a printer, preferably a POS printer with paper as disclosed herein.

The adhesive can be applied in discrete areas so as to leave bands or zones across the entire width of the paper (transverse to the longitudinal axis of the paper) free of adhesive.

The adhesive can be applied to the paper such that there is no adhesive on the paper where the cutting blade or blades either start or end its or their cut. For example, many printers will cut the labels from the paper roll from one of the two sides of the paper in the roll. However, it is expected that such blade(s) will cut through, rather than avoid, the adhesive disclosed herein.

Additionally or alternatively, one or both of the edges of the paper can be free of adhesive. Preferably the adhesive free area can be about 0.125 to 0.375 inches or more, measured from the edge of the paper. This is helpful when using the lightweight paper described herein because when the cutting blade cuts through adhesive, the lightweight paper will tend to crimp slightly and can cause a deflection in the paper that will catch as the paper exits the printer. It is also possible to have only one layer of adhesive applied near the edge of the paper where the cutting blade starts or stops in order to help minimize the crimping or deflection of the paper as the blade cuts through the glue. It is appreciated that less glue can cause less crimping or deflection.

Some printers, such as the Star Micronics TSP650 use two blades that cut from the sides and leave a tie in the middle. For, such printers, the paper may also be free of adhesive along the longitudinal axis of the roll where the paper is not cut.

POS printers typically have a moving blade that cuts the paper from one side to the other. Examples of these printers are the TransAct Ithica 8000 and 8040 and the Epson Restick and TML-90 printers.

Typically, as the paper reaches the outlet of the printer or is exiting the printer, a moving blade cuts the paper across the web. Typically the moving blade hits a stop or stationary blade at the other side of the paper to complete the cut through the web.

It has been discovered with light weight paper that the paper may not have the form or agility to survive this process without bending, folding or otherwise being distorted. This is particularly true when the cutting blades must cut through glue. This can lead to paper jamming during the cutting operation and as a result of the generally flimsy nature of the paper.

To combat this, it is preferable to have the paper free of adhesive where the blade starts to cut and preferably also where it finishes its cut.

Accordingly, one or both of the lateral edges of the paper can have no adhesive, thereby creating an adhesive free zone over the substantial length of the paper and on one or both of the lateral edges, as described herein.

This effect or result may be achieved by leaving out or omitting part of the pattern of adhesive on the web of paper. For some printers, it is more important to ensure that there is no adhesive where the blade starts its cut at an edge of the paper than where it ends its cut on the opposite side. This would mean that there should be a larger dry area on the side where the cutting blade starts its cut than is required where the blade ends its cut. As a consequence of this the pattern on the web may be asymmetrical around the center line of the paper in its commercial roll. For example, the adhesive may be spaced further from one edge of the paper than is the case on the other side of the paper—the larger spacing being arranged on the side where a single blade will start its cut. In addition or alternatively, the adhesive may be in multiple layers, such as two, and where the first layer is partially exposed on the side or sides where the blade or blades begin its cut or their cuts. That is the second and any subsequent layers of adhesive are out of register with the first layer, for example the second and any subsequent layers are applied to a portion of the adhesive areas adjacent the center line of the individual roll and not on a portion of the adhesive areas adjacent an edge or both edges of the roll.

Another feature of this disclosure is the ability to register areas of adhesive on the paper despite multiple applications of adhesive thereto. This registration of multiple "hits" of adhesive may be substantially identical in the sense that the shape of each portion of the pattern of adhesive from the different applications has the same or substantially the same shape. Alternatively, the shapes between the multiple applications can be different, for example, the first being larger than the second. A further example of that is where the second shape is within the first shape but smaller than the first shape. The use of multiple hits of adhesive allows for the adhesive pattern to be modified to suit a particular printer or product application. Thus, the adhesive can be made extra tacky where it is applied as a double hit, and can be less tacky, but still somewhat tacky, where there is only a single hit of adhesive.

This also provides the ability to customize the adhesive and the performance of the paper. Different adhesives with different properties may be used in these multiple applications, which, for example allows having a different degree of adhesion or tack in different areas of the finished label. Moreover, different levels of adhesive solids can be used in each application of adhesive.

Using multiple hits or layers of adhesive also allows for the application of different coat weights of adhesive at each application. For example, a relatively light coat weight may be applied in the first layer and a heavier application of adhesive can be applied in the second layer, or vice versa.

As a result of the efficient cleaning of printer parts and in particular rollers provided by this disclosure, it becomes no longer relevant where the paper is cut by the printer. That is, it does not matter that a printer blade may cut through adhesive in the pattern of adhesive on the web, because the cleaning component removes trace adhesive that would otherwise build up and jam the printer.

In that regard, timing marks that are typically required on POS printer rolls to synchronize the printer with the cutting operation so that the cutter never cuts through adhesive are also no longer required. Thus, this disclosure provides paper and paper rolls having no timing marks for the purpose of ensuring that the cutting blade never cuts through the adhesive. However, it is possible that certain printers and software require a timing mark in order to function and therefore it is possible to apply timing marks to the paper in order to satisfy this requirement and therefore not cause the end users to modify their printers or software to enable them to run without a timing mark of some kind The cleaning component in this disclosure is a material having an affinity for the adhesive and adhesive properties. Thus, preferably, the cleaner acts to "hold onto" the adhesive. The cleaning agent shall preferably be comprised of polymer or resin binders. Polymers or resins include Styrene Butadiene Rubber (SBR), Acrylic, Styrene Acrylic, Polyurethane Dispersion (PUD), and Polyvinyl Acetate (PVA). Other components of the cleaning agent include water, starch cellulose, pigments such as titanium dioxide, calcium carbonate and silica, surfactants, and other organic and/or inorganic hydrophilic fillers or components. There are several suitable cleaning agents available on the market and are known to a person skilled in the art. One preferred water based Polyvinyl Acetate (PVA) cleaning agent is commercially available from Royal Adhesives under product number 3992 PMR.

The cleaning agent is designed to prepare the surface of the paper substrate before the adhesive is applied. Other adhesive coating systems are commercially available and can also be used The purpose of the cleaning agent layer is primarily known as for preparation of a paper's surface. One function of the cleaning coating serves as a barrier layer that helps to keep the adhesive from seeping into or through the paper. It is understood that it is possible to provide a separate primer or barrier layer between the paper and the cleaning agent. Another function is to improve the anchorage. When an adhesive is applied directly to a papers surface without the use of cleaning agent, it may easily be rubbed off. The cleaning agent is designed to improve the bond by first bonding well to the paper's surface and then by allowing the adhesive to bond well against the cleaning layer. One who is skilled in the art would know that most common grade paper substrates can be coated with an adhesive without the use of a cleaning agent. Therefore the use of cleaning agent is to enhance overall anchorage while preventing adhesive migration.

The action of the cleaning agent is to coat paper surfaces in areas where the adhesive is purposely left absent.

It is important that a cleaning agent is a true match or partner of the adhesive used within this cleaning system. The cured adhesive must have a strong attraction to, or affinity for the cleaning agent, and vice versa. This is achieved in theory with use of a functional, mechanical and chemically produced activity. The cleaning agent is preferably very hydrophilic. Hydrophilic primer may comprise an adhesion promoter or an hydrophilic adhesion enhancement compound. The first ensures the link within the cleaning agent coating and, importantly, to the substrate. Like this, a permanent change of the surface energy is easily achieved. This leads on to an increased interaction capability to the functional coating, i.e. a better adhesion. The matching of the system is chemically achieved with each coating having common resins and/or polymers. If using an acrylic adhesive, it is recommended that the cleaning agent is also of an acrylic make up.

This disclosure also provides printers loaded with paper as disclosed herein and also relates to the use of the paper disclosed herein to produce removable or repositionable labels.

This disclosure also provides methods of making paper suitable for use as removable or repositionable labels, the paper having a weight of less than about 70 gsm, the method comprising the steps of applying to the paper at least one layer of material having an affinity for the following adhesive, either directly to the paper or to at least one layer of another material on the paper; substantially drying the material layer; applying a first layer of adhesive to thereon; substantially drying the adhesive; applying at least another layer of adhesive on the first layer of adhesive; substantially drying each another layer before applying an additional layer; each layer of adhesive being applied to generate isolated areas of adhesive surrounded by said material; the material having an affinity for the adhesive so that, in use, the material tends to clean rollers over which the adhesive bearing paper may pass.

The amount of adhesive applied in the first layer is preferably less than the amount applied in the next layer.

There can be two layers of adhesive.

The adhesive can be applied so as to leave adhesive free areas extending across the width of the paper.

The separation of the areas can be configured to be not equal to the circumference of the rollers.

These methods can be applied to the paper disclosed herein.

This disclosure also provides methods of cleaning a roller in a printer over which paper bearing adhesive passes, the method comprising: providing paper as disclosed herein; moving the paper past the roller so that the adhesive cleaning material, adhesive cleaning layer or non-adhesive material having an affinity for the adhesive, respectively, tends to remove adhesive from the roller to minimize the paper jamming or fouling the printer.

The primer or cleaning material can comprise polyvinyl acetate and/or titanium dioxide.

This disclosure also provides methods of making removable or repositionable lightweight paper labels, the method comprising operating a printer loaded with paper as disclosed herein, wherein the printer cuts the paper to make the labels and in so doing cuts though the adhesive.

This disclosure also provides methods of making adhesive paper suitable for use as removable or repositionable labels, the paper having a weight of less than about 70 gsm, the method comprising; applying a coating on one side of the paper, the coating comprising a material having an affinity for the adhesive; applying a first layer of the adhesive on the coating and in a pattern of discrete adhesive areas each substantially surrounded by exposed coating; applying at least one subsequent layer of adhesive on top of the previous layer or layers of adhesive; and either each subsequent layer not being applied outside of the adhesive areas of the previous layer or layers and being substantially the same and/or less size than each of the previous layer or layers or one or more of the subsequent layers being applied in an area or areas larger than that or those of the first layer.

The material can act as a cleaning agent for adhesive deposited on rollers in the manufacturing line and/or printers.

The dry weight of adhesive applied per unit area of the paper can be different between one application and another application.

The adhesive applied in one application can be different from the adhesive applied in another application.

The paper can have two or three layers of adhesive.

The amount of adhesive on the paper can be from about 6 to 18 gsm of dry adhesive.

The paper is preferably thermal paper.

The adhesive areas can have a shape that is substantially that of a parallelogram having two interior angles greater than 90 degrees.

The paper can comprise one or more columns of adhesive areas, each column comprising pairs of such adhesive areas in which the individual adhesive areas are arranged at an angle to each other.

The angle is preferably about 45 degrees.

The paper disclosed herein can be made by either flexographic or direct or offset gravure processes. The latter has the advantage that adhesive disclosed herein may be achieved with a single layer or application, instead of multiple layers or applications. The volume of the cells on the cylinder can be designed to apply enough adhesive that would otherwise be applied in multiple layers, such as by a flexographic process. Thus, the gravure process can be used to apply in a single application sufficient adhesive that otherwise would have taken multiple layers. For example, to create a relatively light continuous band or column with heavier spots can be achieved using a gravure process in which the cells that carry the adhesive for the spots have a greater volume than those carrying the adhesive for the continuous band. So, instead of using a light stripe having an adhesive volume of 5 with a spot pattern having an adhesive volume of 10, a single gravure cylinder can be engraved with a pattern that creates the spots at 10-15 and the areas in between at 5, or more particularly using the data for patterns disclosed herein.

Thus, this disclosure provides a method of making adhesive paper suitable for use as removable or repositionable labels, the paper having a weight of less than about 70 gsm, and having a coating thereon, the method comprising; applying adhesive to the coating in a single step using a gravure process in which a roller is etched to have cells configured to provide a first amount of adhesive applied in isolated areas and cells configured to provide a second amount of adhesive applied between the areas, the amount of adhesive in the first amount being more that the second amount, measured on a dry weight per unit area basis. The coating can comprise a material having an affinity for the adhesive. The paper can have a longitudinal axis and a width, the axis extending along the centerline of the width, the areas forming at least one column on each side of the axis.

BRIEF DESCRIPTION OF THE DRAWINGS

Some preferred features of this disclosure will now be more particularly described by reference in and to the following figures, which are only exemplary of the disclosure.

FIG. 4 is a schematic representation of a POS printer showing the flow of paper there through;

DETAILED DESCRIPTION

Figure 1:
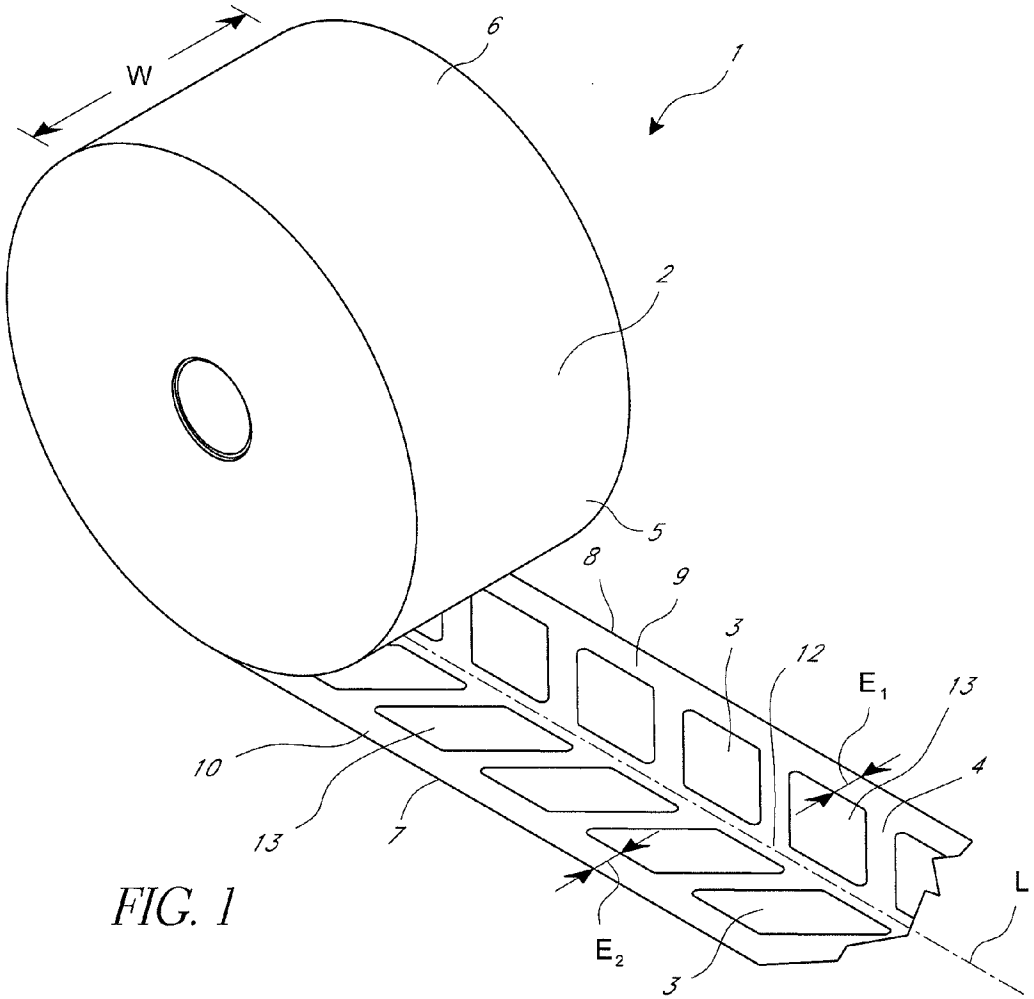
FIG. 1 is a perspective view of a paper roll according to this disclosure.

FIG. 1 illustrates a roll (1) of paper according to this disclosure. Roll (1) comprises paper (2), which is preferably thermal paper suitable for use in POS printers. Roll (1) is typically cut from a wider roll produced from a coating line or printing press and has a width (W) a longitudinal axis (L).

A pattern of adhesive (3) is applied to the inner surface (4) of the roll and a release coating (5) is applied to the outer surface (6) of the roll, so that the adhesive layer will not stick to the roll itself.

Preferably the edges (7) and (8) of the inner surface of the roll have an adhesive free zones (9, 10) along each of the outer edges of the inner surface and having transverse widths ($E_1$, $E_2$).

Optionally, the center line (11) in the center of the web and extending along with longitudinal (L) axis is also an adhesive free zone (12) having a transverse width (C).

Adhesive patches (13) are preferably separated from one another. Thus the adhesive can form islands of adhesive. Thus the adhesive is preferably not continuous along the length of the paper.

Figure 2:
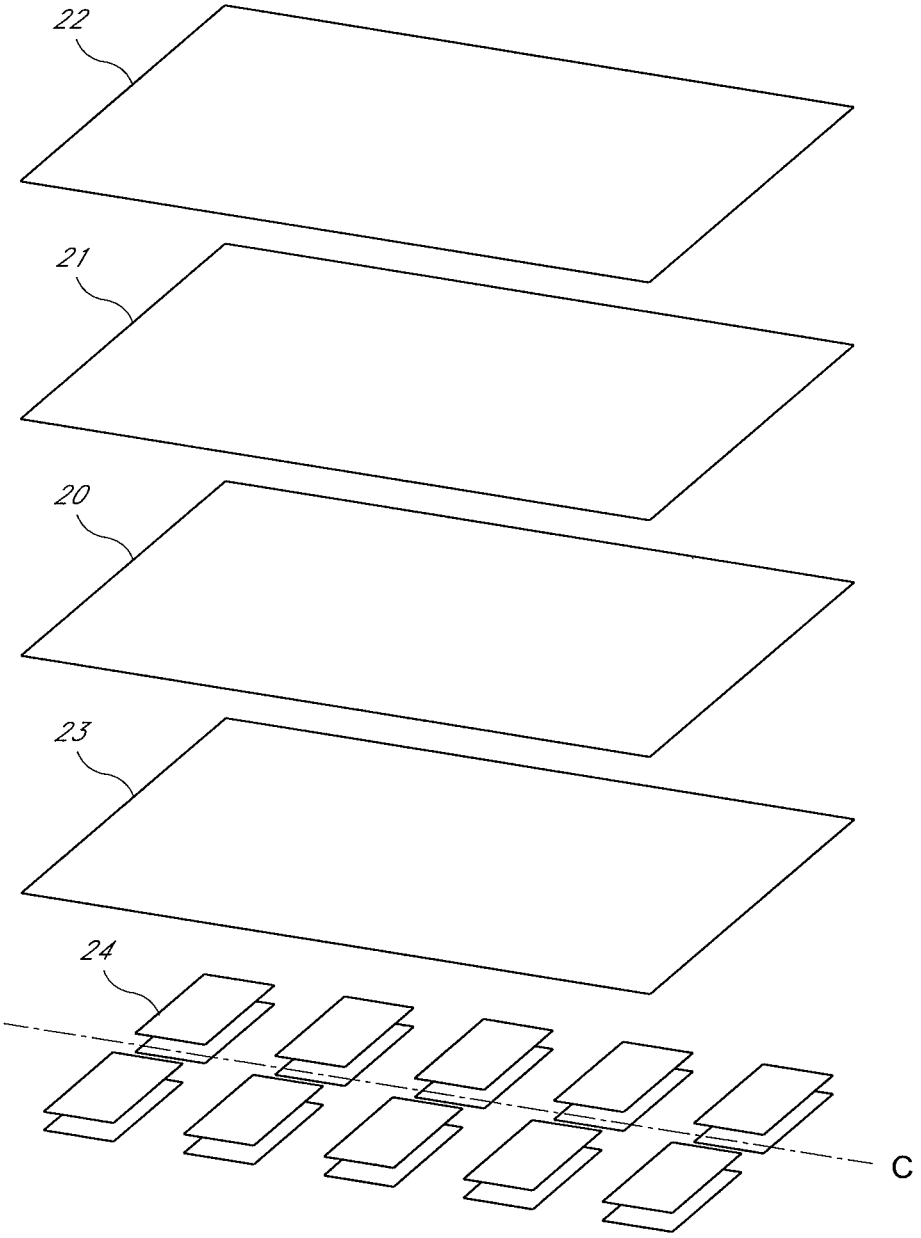
FIG. 2 is an exploded, schematic, perspective view of paper according to this disclosure, showing various layers.

FIG. 2 illustrates a preferred construction of the paper according to the disclosure. Paper (20) is coated with top coat (21) which in turn is coating with a release layer (22). Top coat (21) may be a single or multiple layers, such as two layers. The top coat is useful on thermal paper to avoid activation of the thermal layer by handling of the paper or by the release layer. On the opposite side of the paper, a primer and/or cleaning layer (or layers) (23) is provided and on that an adhesive layer (24), preferably applied in two or more layers. Adhesive (24) is arranged in a series of discrete areas, particles or spots. These are preferably individually isolated and spaced apart. They are preferably symmetrically arranged on either side of the center line (C). Paper (20) is a light weight paper, preferably having a weight of 40 to 65 gsm. For POS printers the paper is a thermal paper having a thermally responsive treatment on the surface facing the top coat layer (21). Paper can be utilized that has a suitable top coating from the paper mill, or a suitable top coat can be applied in line. Compositions of a suitable top coats include aqueous acrylate systems, or other systems known by a person skilled in the art. Suitable release layers (22) comprise similar water based acrylate systems, such as 6960 REL, or a UV based release layer (22) can be applied. Primer/cleaner layer (23) can also be a water based acrylate, such as that available from Royal Adhesives under product number 3992 PMR.

The adhesive (24) preferably comprise two or three layers or applications of adhesive. Two layers or applications are more preferred in which the first layer or application is applied in less volume than the second. For example, the first can be from about 6.0 to 15.5 gsm of wet adhesive running at approximately 47% solids, preferably from about 8.0 to about 10.0 gsm of wet adhesive; and the second from about 8.0 to about 22 gsm of wet adhesive running at approximately 47% solids; preferably from about 10.0 to about 12.0 gsm of wet adhesive. It is understood that the first layer of adhesive can be applied in the same or greater volume than the second layer. It is also understood that the first layer of adhesive can run at a different level of solids than the second layer.

The adhesive is preferably a microsphere adhesive which typically has desirable adhesion versus removability properties. Microsphere adhesives are typically composed of spheres measuring about 10 to 250 microns in diameter, preferably from 25 to 50 microns, which form an uneven film, limiting the amount of surface area contact between adhesive and substrate because of the microspheres. Suitable adhesives can be obtained from Franklin Adhesives or National Starch, with a preferable adhesive available from Royal Adhesives under product number 3991 PLV.

Figure 3:
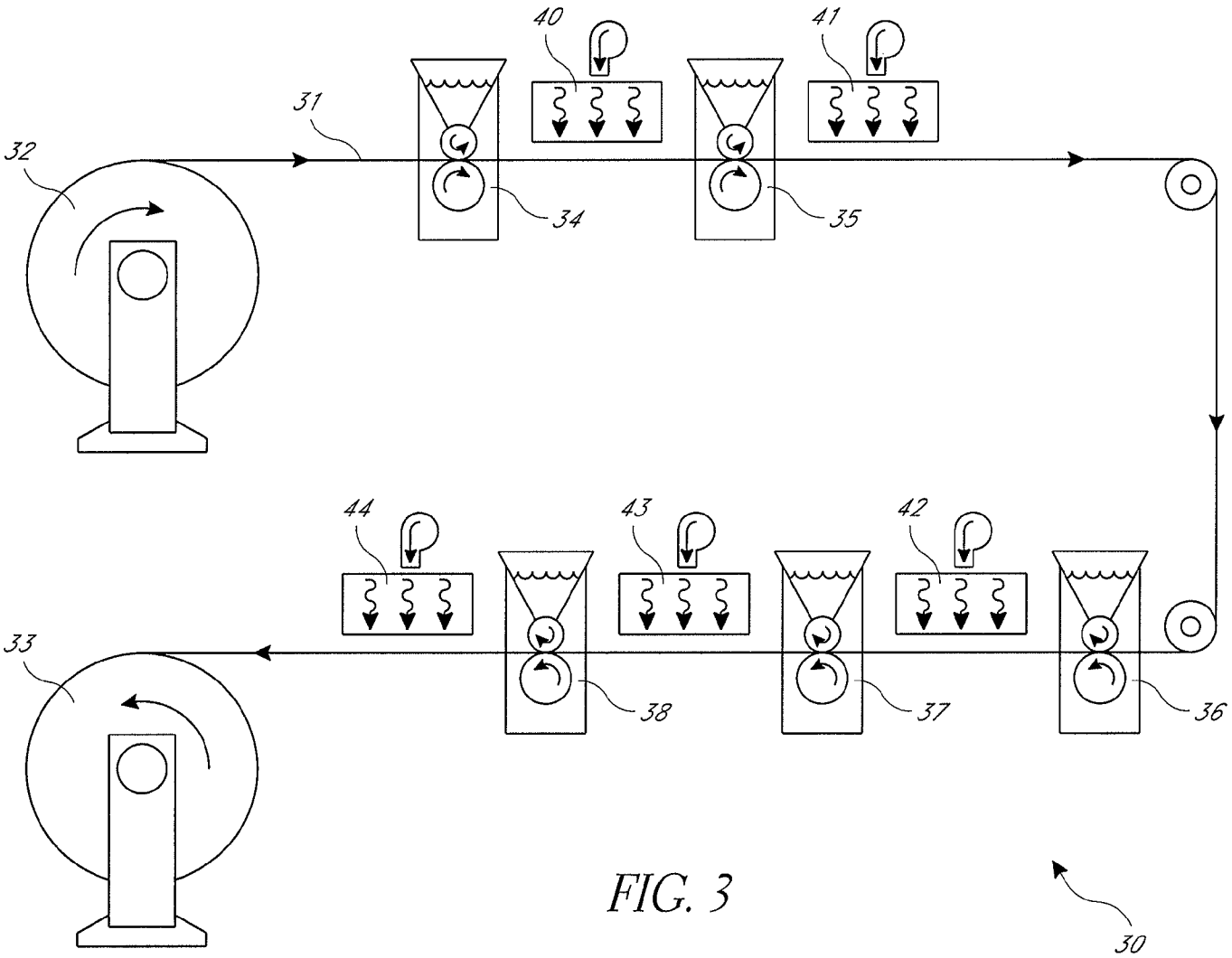
FIG. 3 is a schematic representation of a coating process showing production of paper according to this disclosure.

FIG. 3 illustrates one way of making the paper according to this disclosure. FIG. 3 shows a coating line. Paper substrate (31) on a feeder roll (32) is fed into the line for receiving the various coatings described herein and exits the line onto a take up roll (33). Roll (33) is ultimately cut into smaller rolls of desired dimensions suitable for customers.

It will be appreciated by those skilled in the art that different processes could be used to make the paper and paper rolls of this disclosure. It will also be appreciated that variations of the process described in FIG. 3 could also be made. It is also appreciated that this process could also be performed on a traditional printing press that uses flexographic or gravure processes, or a combination thereof.

As shown in FIG. 3, the line (30) comprises five stations (34, 35, 36, 37 and 38). Station 34 applies top coat to the paper (31). It is understood that this station could be eliminated from the process if the paper utilized has already been coated with a suitable top coating. Station 35 applies a release layer on top of the top coat. The paper is then turned over and a station (36) applies a primer layer that acts as a cleaning agent on the other side of the paper (31). Stations (37) and (38) apply adhesive on the cleaning layer. Any coating can be applied in one or more layers to achieve the desired result by adding a coating station or applicator.

After each coating is applied, heaters (40, 41, 42, 43 and 44) associated with each station dry the relevant coating on the paper (31) as the paper passes through the respective unit.

In each heater, the paper follows an elongated path past heating lamps, the length of the pathway through a heater and the number of heating lamps used being selected to ensure that when the paper (31) exits the heater of a particular station it is substantially dry, and yet, in the case of thermal paper, the temperature in the heater is not allowed to rise to such a level sufficient to activate the thermal coating on the paper that would discolor the paper.

Figure 4:
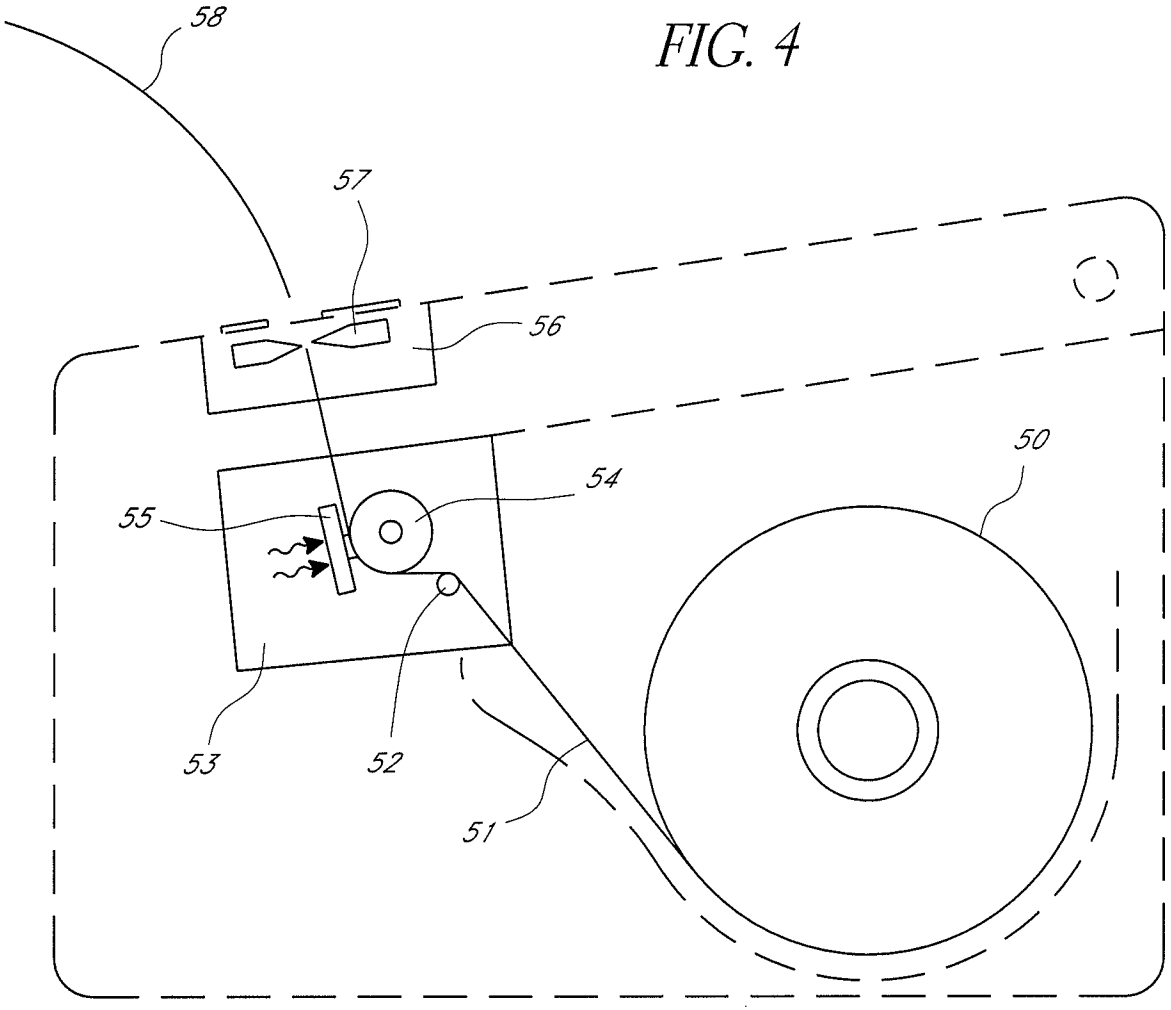

FIG. 4 illustrates a typical POS printer. The roll (50) of paper (51) is drawn over a paper guide (52) to a print head zone (53). In the print head zone (53), a platen roller (54) drives the paper past a print head (55). Since the paper is thermal paper, the print head (55) imparts by heat printing on the paper (51).

The paper is then fed to cutting zone (56), where a blade system (57) cuts the paper to generate a separate receipt (58).

Figure 5:
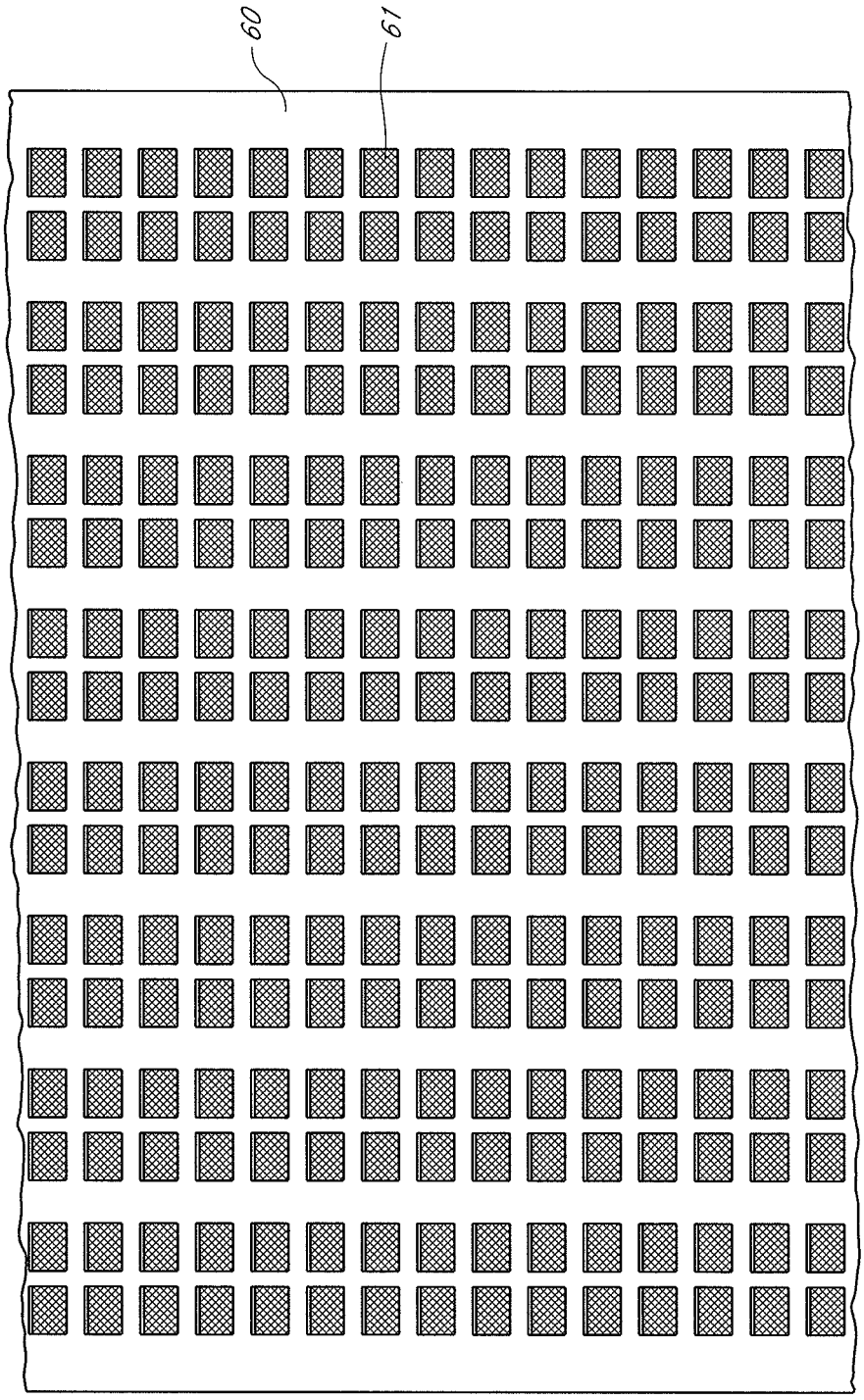
FIG. 5 is an illustration of a pattern of adhesive on paper according to this disclosure.

FIG. 5 illustrates one pattern of adhesive on the paper (60) and comprises a plurality of generally rectangular spots or patches of adhesive (61). As illustrated, each spot or patch of adhesive is surrounded by areas with no adhesive. The spots are arranged in columns of two side-by-side rectangles, two sets of columns being ultimately intended for a single roll, such that FIG. 5 illustrates paper (60) that will ultimately be cut into four rolls for commercial purposes.

Figure 6:
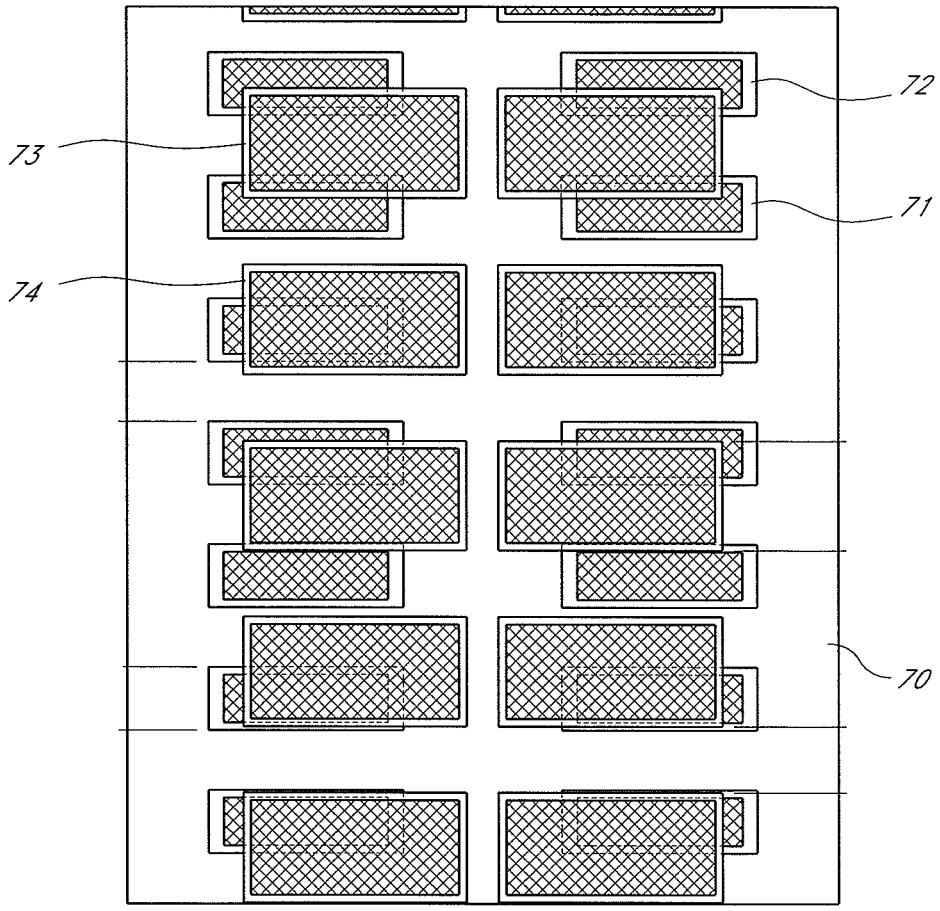
FIG. 6 is an illustration of another pattern of adhesive on paper according to this disclosure.

FIG. 6 illustrates a similar pattern of adhesive spots or patches, on paper (70) the spots (71) being generally rectangular areas of adhesive in rectangles (72) that are applied first to the paper (70) and rectangles (73) that are applied second to the paper. This figure illustrates how the repeat length between the rectangles of adhesive (72) are different than the repeat length between the rectangles of adhesive (73). FIG. 6 therefore shows 2 repeating patterns that are not in register.

Figure 7:
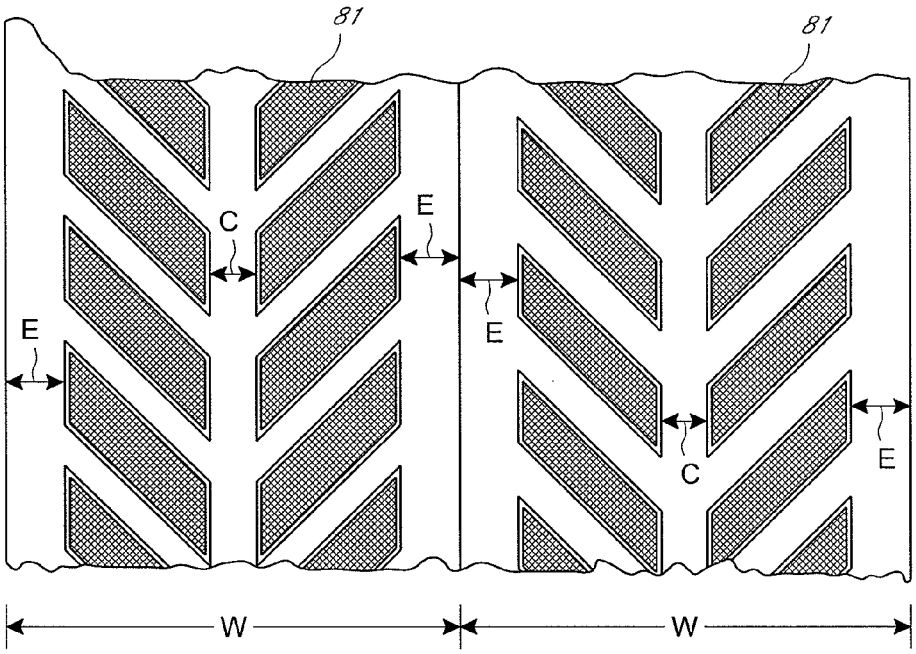
FIG. 7 is an illustration of other patterns of adhesive on paper according to this disclosure.

FIG. 7 illustrates paper (80) having two pairs of columns of adhesive and that would produce, by cutting down the middle, two rolls of adhesive labeling. The adhesive patches (81) are arranged in generally tire tread design spaced apart along their longitudinal axis by the distance (C). Each roll when cut will provide strips or bands of non-adhesive coated paper extending along the length of the roll between the adhesive patterns and the respective lateral edges of the roll (and having a lateral width (E)). As illustrated, the adhesive patches are angled at about 45° to the center line of each, ultimate paper roll. It is appreciated that the pattern with the larger areas of glue will be tackier than the pattern with the smaller areas of glue.

Figure 8:
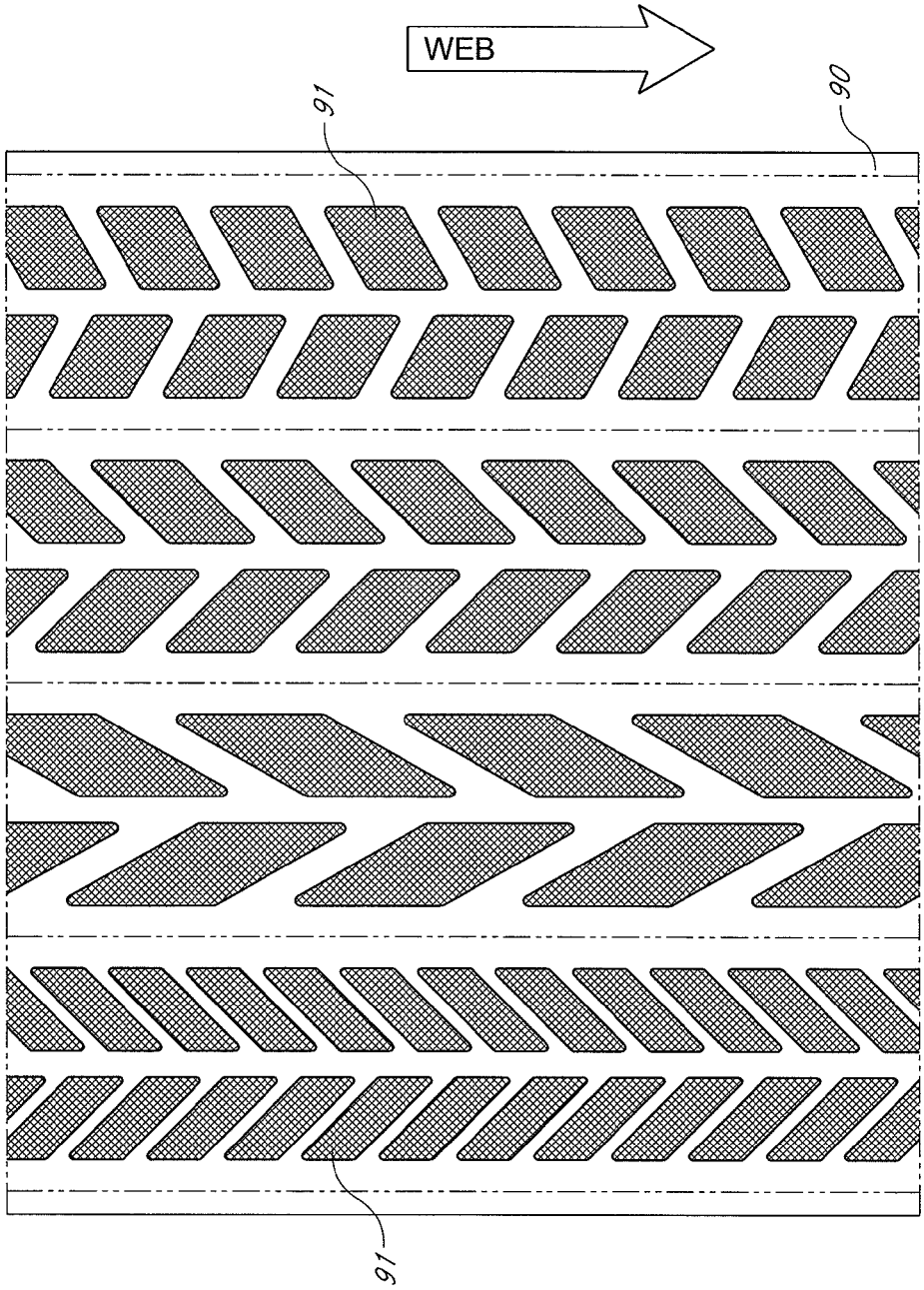
FIG. 8 is an illustration of other patterns of adhesive on paper according to this disclosure.

FIG. 8 illustrates paper (90) carrying four pairs of columns of adhesive spots (91) that would ultimately be cut into four rolls of labels. Each spot (91) is isolated from the other spots and angled towards the center line of each sub roll at angles from about 30° to 60°.

Figure 9A:
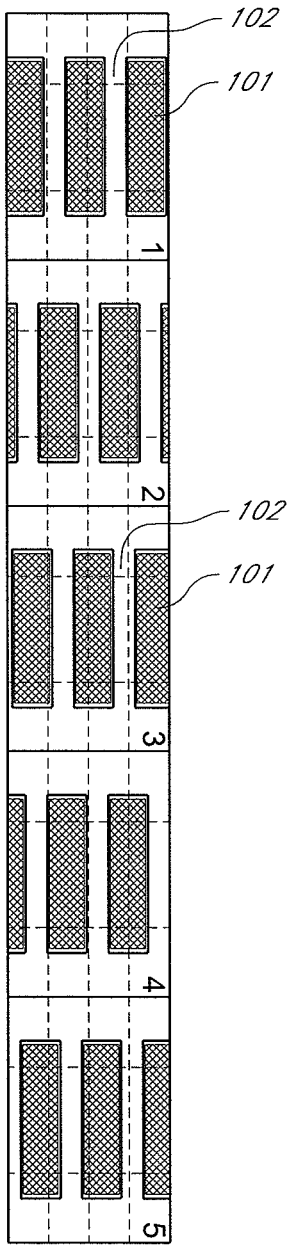
FIG. 9*a* is a further illustration of the spacing relationship on paper according to this disclosure shown in FIG. 9.
Figure 9:
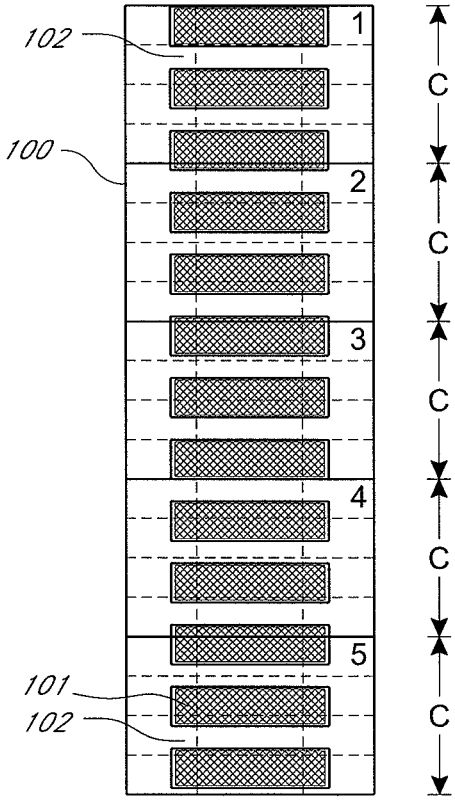
FIG. 9 is an illustration of the relationship between certain adhesive spacing on paper according to this disclosure and a printer roll.

FIG. 9 is a schematic representation of the roller (100) of a printer laid flat and having circumference C. FIG. 9 shows a sequence of five rotations of the roller and illustrates how the paper may move over the roller, so that adhesive patches (101) are out of sync with the roller (100) and the cleaning areas (102) are designed to sweep across and contact non-repeating portions of the roller circumference.

FIG. 9*a* is another representation of FIG. 9, showing the five rotations of FIG. 9 in side by side format, to more clearly show the places on the roller where the adhesive patches (101) and the cleaner areas (102) will contact the roller as the paper moves through the printer.

Figure 10A:
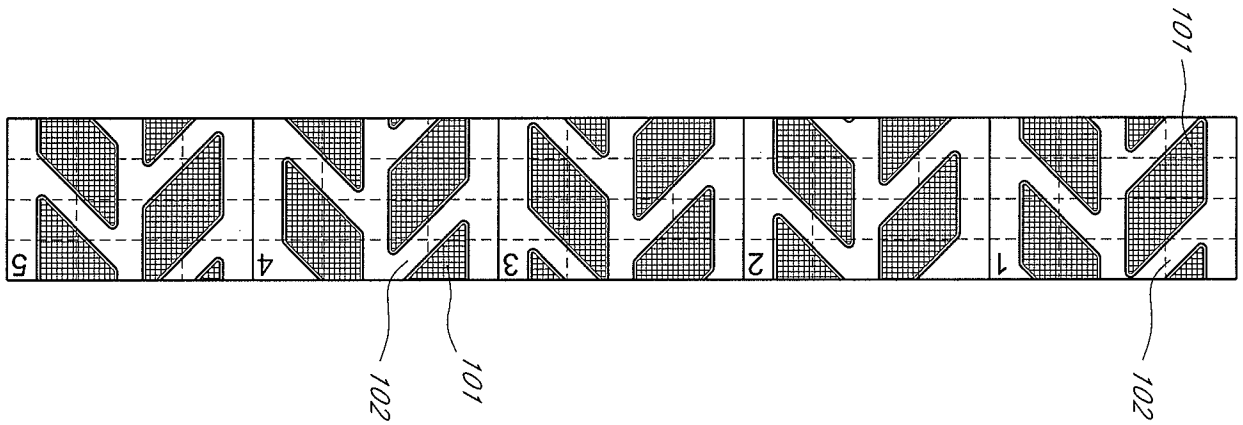
FIG. 10*a* is a further illustration of another spacing relationship shown in FIG. 10.
Figure 10:
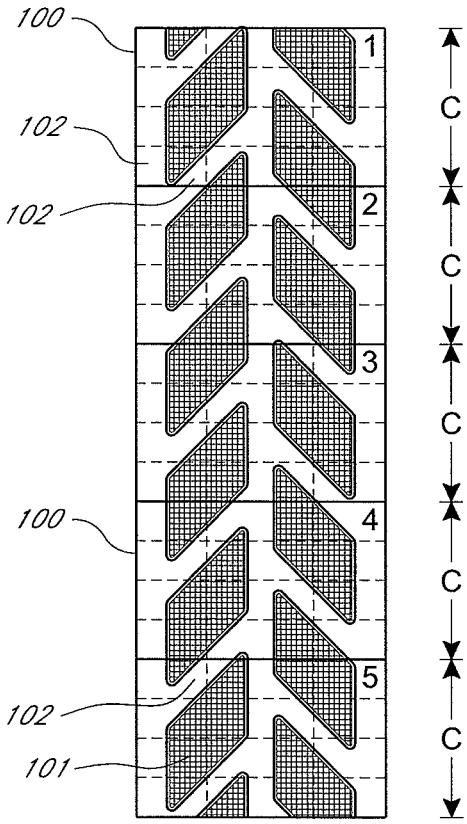
FIG. 10 is an illustration of another spacing relationship on paper according to this disclosure.

Similarly, FIG. 10 is a schematic representation of the roller of a printer laid flat and having circumference C. FIG. 10 shows a sequence of five rotations of the roller and illustrates how the paper may move over the roller, so that adhesive patches (101) of a different shape are out of sync with the roller and the cleaning areas (102) are designed to sweep across and contact non-repeating portions of the roller circumference.

Similarly, FIG. 10*a* is another representation of FIG. 10, showing the five rotations of FIG. 10 in side by side format, to more clearly show the places on the roller where the adhesive patches (101) and the cleaner areas (102) will contact the roller as the paper moves through the printer.

Figure 11:
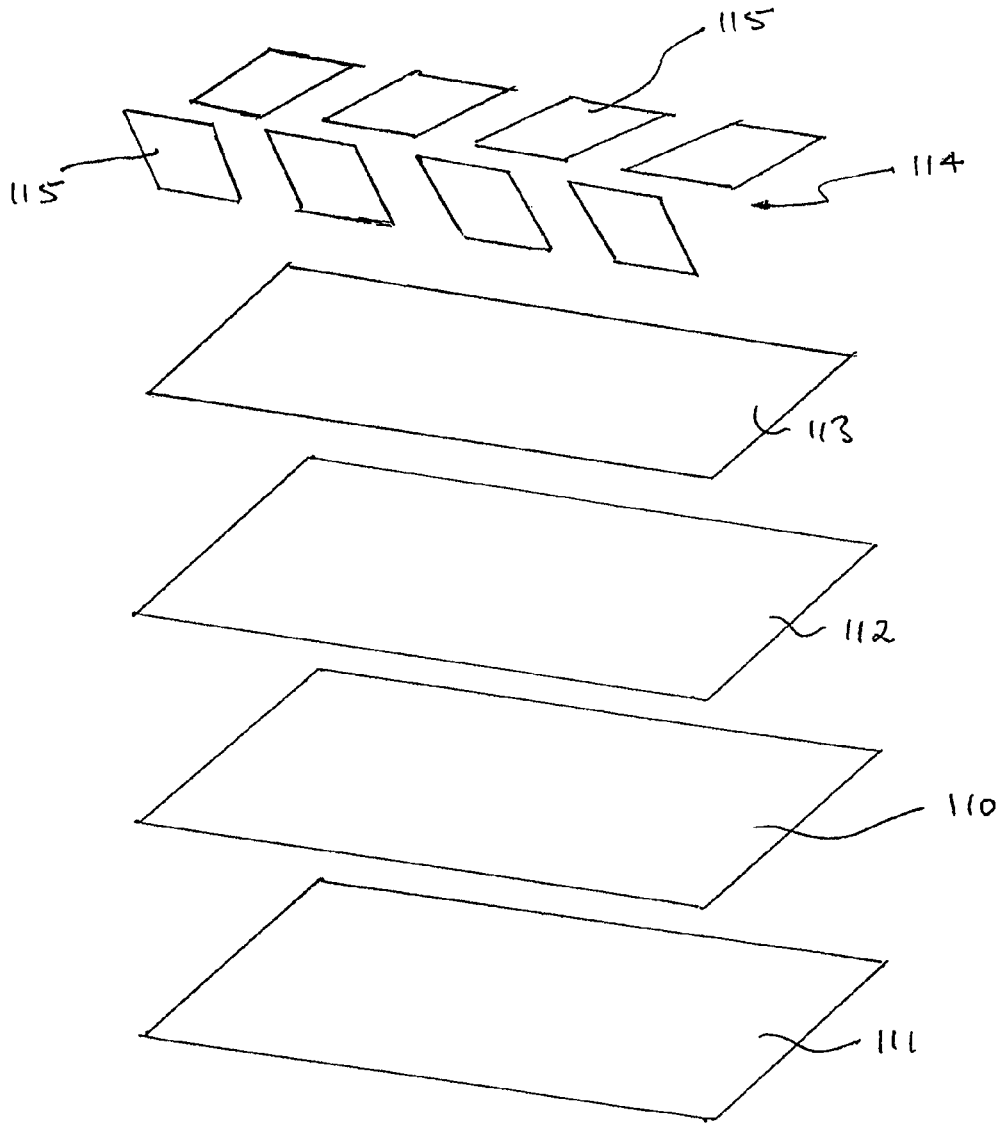
FIG. 11 is an exploded, schematic, perspective view of paper according to this disclosure, showing various layers. This is an illustration of a pattern of adhesive on paper according to this disclosure.

FIG. 11 illustrates another preferred construction of the paper according to the disclosure. Paper (110) is coated on one side with a release layer (111). A top coat (not shown) may be applied to paper (110) between paper (110) and release layer (111). The other side of paper (110) has a cleaning layer (112) to which is applied adhesive layer (113). Adhesive layer (113) is a continuous column strip of adhesive running along the roll of paper. The width of the column of adhesive (113) is slightly less than the width the paper in the paper roll (110), so as to leave adhesive free zones on either side (not shown) which extend along the paper. A second layer of adhesive (114) is applied over the first layer of adhesive (113) in the form of two columns of adhesive patches (115). Adhesive patches (115) are parallelogram shaped with each angled with respect to the center line or longitudinal axis of the paper roll at about 45 degrees.

The construction of FIG. 11 may have a weight ratio amount of second layer adhesive (114) to first layer adhesive (113) of about 2 to 1.

Figure 12:
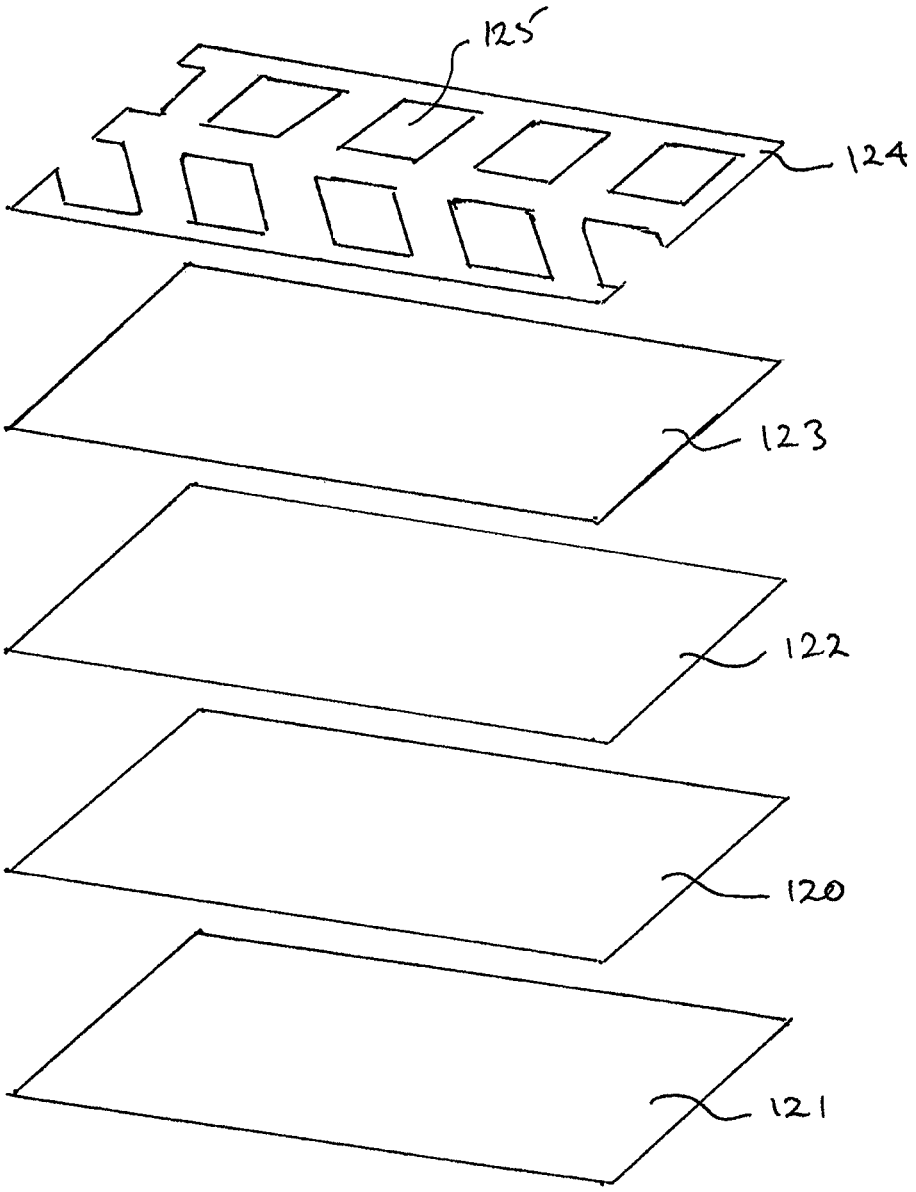
FIG. 12 is an exploded, schematic, perspective view of paper according to this disclosure, as showing various layers. This is an illustration of a pattern of adhesive on paper according to this disclosure.

FIG. 12 is an exploded, schematic representation of a roll of paper (120), preferably thermal paper, having a release coating (121) on one side. A layer of cleaning agent (122) is applied to the other side of the paper, such as by flood coating. A layer of adhesive (123) is provided on the layer of cleaning agent (122) in the form of a substantially continuous strip of adhesive that may span a major or minor portion of the width of paper (120). Preferably, as in other embodiments herein, the adhesive leaves adhesive free zones extending along either edge of the paper. Over the adhesive layer or layers is applied another layer of cleaning agent (124) having windows or holes (125) therein. This effectively modifies the adhesive into a pattern dictated by the pattern of windows or holes (125) in cleaning layer (124).

Figure 13:
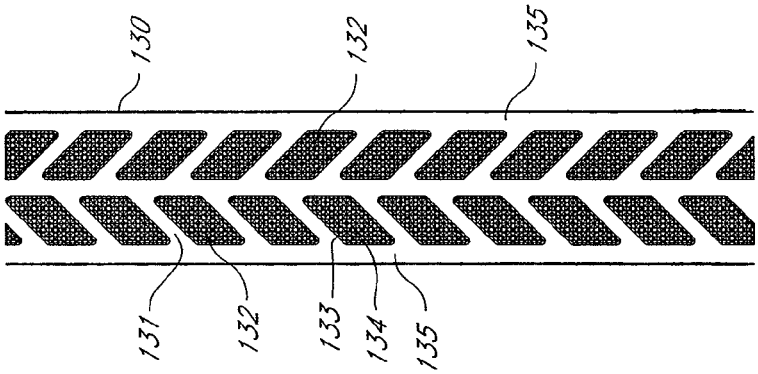
FIG. 13 is a schematic view of paper according to this disclosure, as showing various layers. This is an illustration of a pattern of adhesive on paper according to this disclosure.

FIG. 13 shows a roll of paper (130) having a layer of cleaning agent (131) thereon. Adhesive patches (132) are arranged in two columns along the length of the paper roll in the form of generally parallelogram shaped patches angled toward the center line of the roll and with one column offset from the other, as shown. Each patch (132) is made up of two layers of adhesive: a lower layer (133) and an upper layer (134) in register with the lower layer (133). Adhesive free zones (163) extend along each edge of the paper. Adhesive patches (132) are angled to point in the direction of use of the paper roll.

Figure 14:
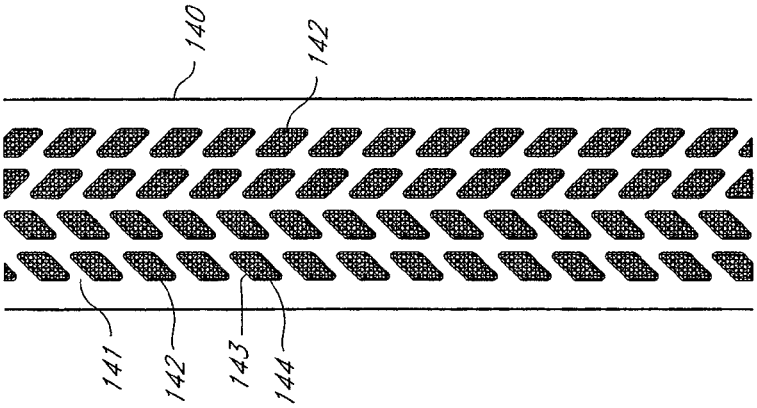
FIG. 14 is a schematic view of paper according to this disclosure, as showing various layers. This is an illustration of a pattern of adhesive on paper according to this disclosure.

FIG. 14 shows paper (140) coated with a cleaning layer (141) and having columns of adhesive patches (142) extending along the roll of paper (140). Each patch comprises a first adhesive layer (143) and a second adhesive layer (144) on top of the first adhesive layer. For each patch, the adhesive layers are in register with each other. Adhesive patches (142) comprise generally parallelogram shaped patches, each inclined with respect to the center line or longitudinal axis (not shown) of the paper. As shown, adhesive patches (142) are generally arranged in four columns extending along the length of the paper roll with the patches inclined towards that axis.

Figure 16:
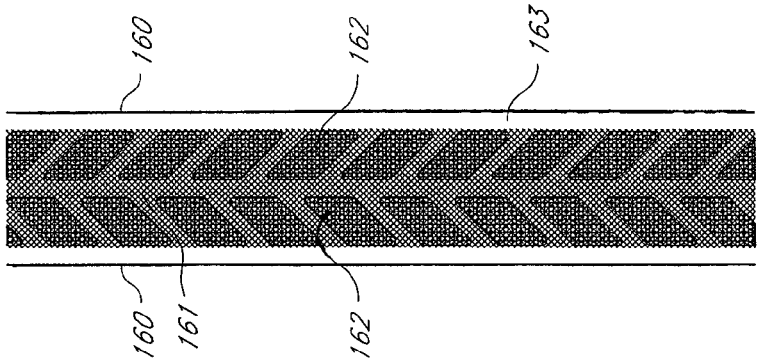
FIG. 16 is a schematic view of paper according to this disclosure, as showing various layers. This is an illustration of a pattern of adhesive on paper according to this disclosure.
Figure 15:
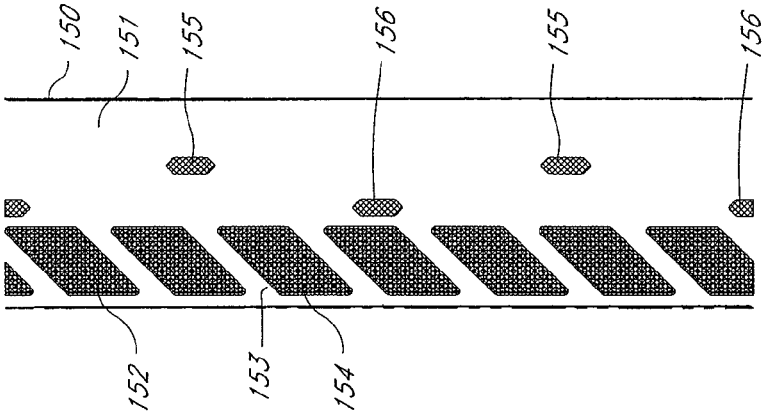
FIG. 15 is a schematic view of paper according to this disclosure, as showing various layers. This is an illustration of a pattern of adhesive on paper according to this disclosure.

FIG. 15 shows paper roll (150) coated with cleaning layer (151). On one side of the longitudinal axis of the paper roll is provided a column of discrete adhesive patches (152). Patches (152) comprise a first layer of adhesive (153) and a second layer of adhesive (154) on top of and in register with the first layer of adhesive. As shown in FIG. 15 each patch of adhesive comprises a general parallelogram shaped area of adhesive angled towards the center line. Additional patches of adhesive (155) are provided on the other side of the center line to at least somewhat balance the weight effect of the patches of adhesive (152) on the other side of the center line. Patches (155) are applied as part of the first layer of adhesive and comprise generally elongated patches. Additional similar patches (156) may be provided near the center line FIG. 16 shows paper made in the manner illustrated in FIG. 11, in which paper (160) has a layer of cleaning agent (not shown) with a broad, first layer of adhesive (161) extending as a column spanning the central axis along the paper roll. A second layer of adhesive is provided in the form of patches (162) extending in two columns along the roll and shaped as parallelograms angled towards the center line and with one column offset with respect to the other. Adhesive free zones (163) extend along each edge of the paper.

Figure 17:
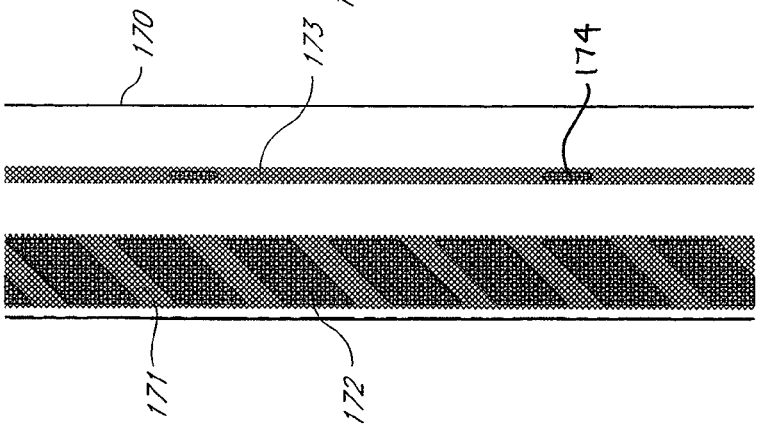
FIG. 17 is a schematic view of paper according to this disclosure, as showing various layers. This is an illustration of a pattern of adhesive on paper according to this disclosure.

FIG. 17 provides a somewhat similar arrangement to FIG. 15 and comprises paper (170) having a first layer of adhesive extending in a continuous column (171) along one side of the paper with respect to the central longitudinal axis. Superimposed on the column are a series of adhesive patches (172) applied as a second layer on top of column (171). Patches (172) are generally shaped as parallelograms inclined towards the central axis of the paper roll. Patches (172) have the same width (with respect to the longer angled sides of the parallelogram as the width of column (171). On the other side of that axis is provided a second, narrower column of adhesive (173). Optionally, the narrower column of adhesive may have, as a second layer on top of it, intermittent, elongate patches of adhesive (174). Patches (174) are preferably within the boundary of adhesive column (173).

Figure 18:
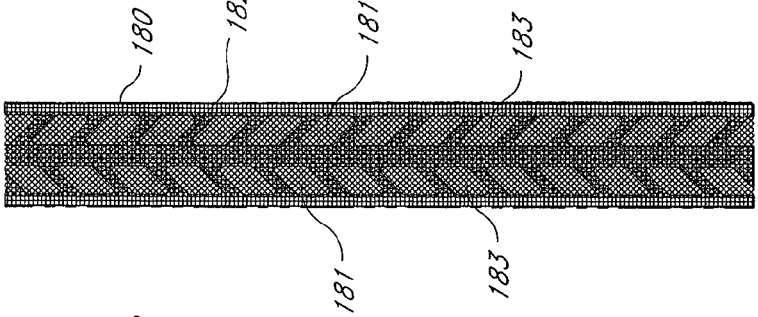
FIG. 18 is a schematic view of paper according to this disclosure, as showing various layers. This is an illustration of a pattern of adhesive on paper according to this disclosure.

FIG. 18 represents a portion of a roll of paper constructed in a manner shown in FIG. 12. The roll in FIG. 14 comprises paper (180) having a layer of cleaning agent (not shown) with a layer of adhesive (181) thereon. On top of the adhesive layer is another layer of cleaning agent (182) having holes (183) therethrough, so as to expose the adhesive (181) in the pattern of the holes. In a similar manner to as shown in FIG. 13, these patterns are formed by two columns of spaced, parallelogram patches of adhesive generated by the windows or holes in the cleaning agent layer (182) and arranged on either side of the center line at an angle thereto.

Figure 19:
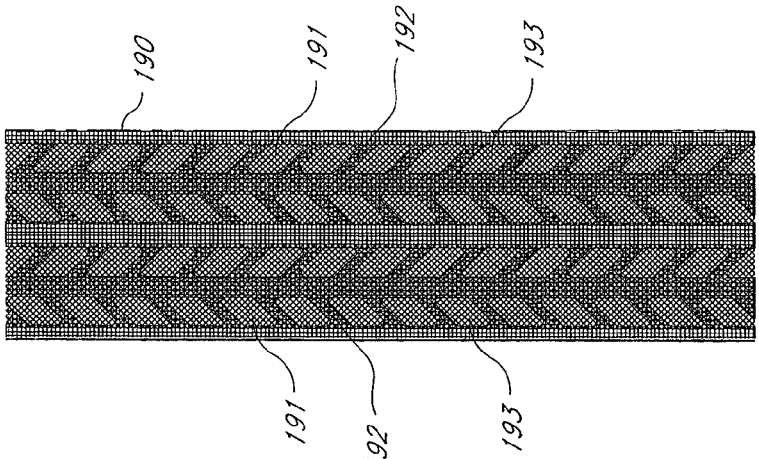
FIG. 19 is a schematic view of paper according to this disclosure, as showing various layers. This is an illustration of a pattern of adhesive on paper according to this disclosure.

FIG. 19 comprises a roll of paper (190) that has a similar construction to that described in respect to FIG. 18. Thus, the paper has a coating of material having an affinity for the adhesive (such a layer not being shown in the drawing). On top of that layer is provided a coating of adhesive (191) and on top of that is provided another layer of the material having the affinity for the adhesive (192). That layer having a series of holes or windows therethrough (193) which exposes the underlying adhesive layer as shown in the figure. This produces four columns of exposed adhesive, with two on either side of the center line. Each pair of columns comprises a two columns of adhesive patches inclined towards each other and each patch having a generally parallelogram shape.

Figure 20:
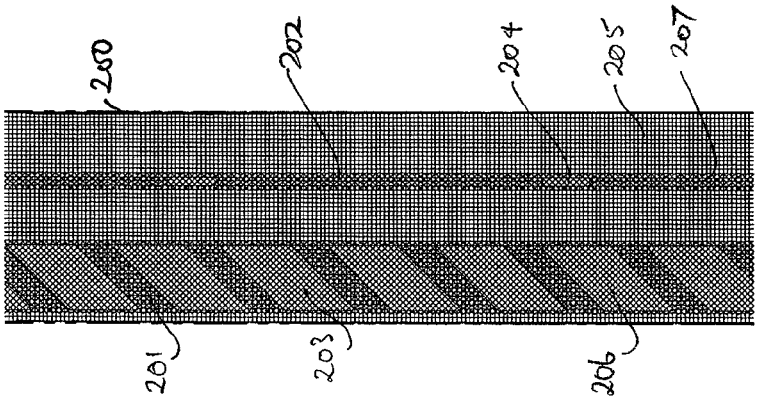
FIG. 20 is a schematic view of paper according to this disclosure, as showing various layers. This is an illustration of a pattern of adhesive on paper according to this disclosure.

FIG. 20 represents a portion of a roll of paper constructed in a similar manner to that of FIGS. 18 and 19. In essence, paper having a pattern similar to that of the paper in FIG. 17 is prepared in the same manner as that in FIGS. 18 and 19.

Thus, the paper roll in FIG. 20 comprises paper (200) covered with a first layer of material having an affinity for the adhesive (not shown) and having a first layer of adhesive in the form of two columns extending along the roll as (201 and 202) with column (201) being wider than column (202). Optionally, as shown, a second layer of adhesive is applied on each column in patterns representing a smaller area than that of the respective, underlying column. The second layer of adhesive on the wider column being in the form of spaced patches generally in the shape of parallelograms (203) and being shaped on the narrower column as spaced apart elongated portions (204) within the width of that column that paper having an upper layer of cleaning agent (205) covering the paper and having windows or holes (206 and 207) so as to expose the underlying adhesives. Thus, these windows have substantially the same shape as that of columns (210 and (202).

Accordingly, this disclosure provides:

Paper, suitable for use as removable or repositionable labels, comprising:

- a paper substrate, having a weight of less than about 70 gsm, a width extending between lateral edges, a longitudinal axis extending along the center of the width, an upper side and a lower side,
- the upper side supporting a release layer;
- the lower side supporting at least one layer of an adhesive cleaning material;
- a pattern of adhesive on the adhesive cleaning material;
- the pattern of adhesive being disposed on both sides of the longitudinal axis in the form of a plurality of substantially discrete adhesive areas, so that the adhesive along the paper in the direction of the longitudinal axis is not continuous;
- at least some of the adhesive areas being applied in multiple layers.

A roll of thermal paper,

- the paper having a weight of less than about 70 gsm;
- the roll comprising a first side treated with thermally reactive material, a top coat over the thermally reactive material and a release layer on the topcoat;
- an adhesive cleaning layer on the other side of the paper and adhesive on the cleaning layer;
- the adhesive being such that labels produced from the roll are removable or repositionable;
- the adhesive being in discrete areas surrounded by exposed cleaning layer.

A roll of paper, for producing removable or repositionable adhesive labels on a POS printer, the paper having a weight of less than about 70 gsm, the roll comprising on one side of the paper adhesive in the form of substantially discrete patches applied to one or more intervening layers between the paper and the adhesive;

the amount of adhesive on the paper being from about 6 to about 18 gsm of dry adhesive.

Paper as in paragraph 0118, wherein the amount of adhesive is from about 8 to about 10 gsm.

A roll of paper, having a weight of less than about 70 gsm, and having adhesive patches along the length of the roll to produce at least one repeat pattern in that direction;

each repeat pattern having a repeat length;

the patches being separated by areas of non-adhesive material that has an affinity for the adhesive;

the spacing of the adhesive and non-adhesive being configured to interact with a printer having a platen roll to facilitate the passage of the paper through the printer, the platen roll having a circumference;

the ratio of each repeat length to the circumference being not a whole number.

A roll as described in paragraph 0122, having one or two repeat lengths.

A roll as described in paragraphs 0122 or 0123, wherein each repeat length is less than the circumference.

A roll as described in paragraphs 0122 to 124, wherein the circumference is one to two inches.

Paper as described in paragraphs 0118 or 0119 or 0125, wherein the paper is thermal paper.

Paper, as described in paragraphs 0119 to 0126, having a longitudinal axis.

Paper as described in paragraphs 0118 to 0127, wherein the longitudinal axis is in the center of the width of the paper.

Paper as described in paragraphs 0118, 0127 or 0128, having a zone free of adhesive extending along the longitudinal axis.

Paper as described in paragraphs 0118 or 0127 to 0129, wherein the adhesive is arranged in columns, the columns being parallel to and on both sides of the longitudinal axis.

Paper as described in paragraph 0130, wherein there are two columns, with one on either side of the longitudinal axis.

Paper as described in paragraph 0128, wherein the adhesive is arranged in one column on the longitudinal axis.

Paper as described in paragraphs 0118 or 0127 to 0132, wherein the adhesive is arranged at an angle of from about 20-70° to the longitudinal axis.

Paper as described in paragraph 0133, wherein the adhesive is arranged at an angle of about 45° to the longitudinal axis.

Paper as described in paragraphs 0118 or 0127 to 0132, wherein the adhesive is arranged asymmetrically on either side of the longitudinal axis.

Paper as described in paragraphs 0118 to 0135, wherein the adhesive covers from about 65-85% of the linear length of the paper.

Paper as described in paragraphs 0118 to 0135, wherein the adhesive covers as least 60% of the width of the paper.

Paper as described in paragraph 0137, wherein the adhesive covers 75-80% of the width of the paper.

Paper as described in paragraphs 0118 to 0138, wherein the adhesive covers at least 40% of the surface area of the paper.

Paper as described in paragraph 0139, wherein the adhesive covers at least 60% of the surface area of the paper.

Paper as described in paragraphs 0118 to 0140, wherein the paper weight is from about 40 to about 65 gsm.

Paper as described in paragraph 0141, wherein the paper weight is about 55 gsm.

A printer loaded with paper as described in paragraph 0118 to 0142.

Use of paper as described in paragraphs 0118 to 0142 to produce removable or repositionable labels.

A method of making paper suitable for use as removable or repositionable labels, the paper having a weight of less than about 70 gsm, the method comprising the steps of applying at least one layer of primer to the paper, either directly to the paper or to at least one layer of another material on the paper;

substantially drying the primer;

applying a first layer of adhesive to the primer;

substantially drying the adhesive;

applying at least another layer of adhesive on the first layer of adhesive;

substantially drying each another layer before applying an additional layer;

each layer of adhesive being applied to generate isolated areas of adhesive surrounded by primer;

the primer having an affinity for the adhesive so that, in use, the primer tends to clean rollers over which the adhesive bearing paper may pass.

A method as described in paragraph 0145, wherein the amount of adhesive applied in the first layer is less than the amount applied in the next layer.

A method as described in paragraph 0145 or 0146, wherein there are two layers of adhesive.

A method as described in paragraphs 0145 to 0147, wherein the adhesive is applied so as to leave adhesive free areas extending across the width of the paper.

A method as described in paragraph 0148, wherein the separation of the areas is configured to be not equal to the circumference of the rollers.

A method as described in paragraphs 0145 to 0148, as applied to paper as described in paragraph 0118 to 0139.

A method of cleaning a roller in a printer over which paper bearing adhesive passes, the method comprising:

providing paper as described in paragraphs 0118, 0119 or 0120 to 0142;

moving the paper past the roller so that the adhesive cleaning material, adhesive cleaning layer or non-adhesive material having an affinity for the adhesive, respectively, tends to remove adhesive from the roller to minimize the paper jamming or fouling the printer.

A method as described in paragraph 0151 wherein the primer or cleaning material comprises polyvinyl acetate.

A method as described in paragraph 0152, wherein the primer or cleaning material comprises titanium dioxide.

A method of making removable or repositionable light-weight paper labels, the method comprising operating a printer loaded with paper as described in paragraphs 0118, 0119 or 0121 to 0142, wherein the printer cuts the paper to make the labels and in so doing cuts though the adhesive.

A method of making adhesive paper suitable for use as removable or repositionable labels, the paper having a weight of less than about 70 gsm, the method comprising;

applying a coating on one side of the paper, the coating comprising a material having an affinity for the adhesive;

applying a first layer of the adhesive on the coating and in a pattern of discrete adhesive areas each substantially surrounded by exposed coating;

applying at least one subsequent layer of adhesive on top of the previous layer or layers of adhesive;

each subsequent layer not being applied outside of the adhesive areas of the previous layer or layers and being substantially the same and/or less size than each of the previous layer or layers.

A method as described in paragraph 0155, wherein the material acts as a cleaning agent for adhesive deposited on rollers in the manufacturing line and/or printers.

A method as described in paragraphs 0155 or 0156, wherein the dry weight of adhesive applied per unit area of the paper is different between one application and another application.

A method as described in paragraphs 0155 to 0157, wherein the adhesive applied in one application is different from the adhesive applied in another application.

A method as described in paragraphs 0155 to 0158, wherein the paper has two or three layers of adhesive.

A method as described in paragraphs 0155 to 0158 wherein the amount of adhesive on the paper is from about 6 to 18 gsm of dry adhesive.

A method as described in paragraphs 0155 to 0161, wherein the paper is thermal paper.

A method as described in paragraphs 0155 to 0161, wherein the adhesive areas have the shape that is substantially that of a parallelogram having two interior angles greater than 90 degrees.

A method as described in paragraph 0162, wherein the paper comprises one or more columns of adhesive areas, each column comprising pairs of such adhesive areas in which the individual adhesive areas are arranged at an angle to each other.

A method as described in paragraph 0163, wherein the angle is about 45 degrees.

A method as described in paragraphs 0155 to 0163, as applied to the paper as described in paragraph 0118 to 142.

What is claimed is:

1. Paper, suitable for use as removable or repositionable labels, comprising:

a paper substrate, having a weight of less than about 70 gsm, a width extending between lateral edges, a longitudinal axis extending along the center of the width, a first side and a second side, the first side supporting at least one release layer;

the second side supporting at least one layer of adhesive;

at least one layer of material between the adhesive and the paper, which material aids in cleaning printer components when the labels are being printed;

the adhesive being in the form of a plurality of substantially discrete adhesive areas having a dry weight per unit area of the paper, the adhesive areas being separated by adhesive having a lower dry weight per unit area of the paper and/or by exposed cleaning material.

2. Paper as claimed in claim 1, wherein the lower dry weight per unit area is about 20-50% of the higher dry weight per unit area.

3. Paper as claimed in claim 1, wherein the lower dry weight per unit area is 2 gsm or less and the higher dry weight per unit area is 4 gsm or more.

4. Paper as claimed in claim 1, wherein the adhesive areas are separated by adhesive and adhesive extends across the width of the paper, except for an adhesive free zone extending along one or both of the lateral edges of the paper.

5. Paper as claimed in claim 1, wherein the areas are separated by adhesive and adhesive extends continuously along the paper.

6. Paper as claimed in claim 1, wherein the adhesive areas are arranged in one or more columns along the paper.

7. Paper as claimed in claim 6, wherein there are at least two columns, with at least one on each side of the longitudinal axis.

8. Paper as claimed in claim 1, wherein the adhesive areas are arranged at an angle to the longitudinal axis.

9. Paper as claimed in claim 8, wherein the adhesive areas are angled to point in the direction of travel of the paper when it is used in a printer.

10. Paper as claimed in claim 8, wherein the angle is about 45°.

11. Paper as claimed in claim 1, wherein the adhesive having a lower dry weight per unit area comprises one or more layers.

12. Paper as claimed in claim 1, wherein said adhesive comprises one or more strips of adhesive extending along the paper.

13. Paper as claimed in claim 1, wherein the adhesive areas comprise one or more layers.

14. Paper as claimed in claim 1, wherein the amount of adhesive on the paper is from about 6 to about 18 gsm, measured as dry weight of adhesive.

15. Paper as claimed in claim 14, wherein the amount of adhesive is from about 8 to about 10 gsm, measured as dry weight of adhesive.

16. Paper as claimed in claim 1, wherein the adhesive comprises a microsphere adhesive.

17. Paper as claimed in claim 1, wherein the adhesive and the cleaning material comprise the same polymeric material.

18. Paper as claimed in claim 1, wherein the paper is thermal paper.

19. Paper as claimed in claim 1, having a weight of about 55 gsm.

20. Paper as claimed in claim 1, designed for one or more commercial printers, the adhesive areas being along the length of the roll to produce at least one repeat pattern in that direction;

each repeat pattern having a repeat length;

the spacing of the adhesive areas being configured to interact with a particular printer or printers having a platen roll to facilitate the passage of the paper through the printer(s), the platen roll having a particular circumference;

the ratio of each repeat length to the circumference being not a whole number.

21. Paper as claimed in claim 1, wherein the cleaning material comprises polyvinyl acetate.

22. Paper as claimed in claim 1, wherein the primer or cleaning material comprises titanium dioxide.

* * * * *